US011136759B2

(12) United States Patent
Phillips

(10) Patent No.: US 11,136,759 B2
(45) Date of Patent: Oct. 5, 2021

(54) STACKING GUIDES

(71) Applicant: Christie Lites Enterprises USA, Orlando, FL (US)

(72) Inventor: John William Phillips, Orlando, FL (US)

(73) Assignee: STAGE LIGHTING PATENTS, LLC, Windermere, FL (US)

( * ) Notice: Subject to any disclaimer, the term of this patent is extended or adjusted under 35 U.S.C. 154(b) by 0 days.

(21) Appl. No.: 16/704,104

(22) Filed: Dec. 5, 2019

(65) Prior Publication Data

US 2021/0172172 A1 Jun. 10, 2021

(51) Int. Cl.

| | |
|---|---|
| ***E04C 3/04*** | (2006.01) |
| ***E04B 1/24*** | (2006.01) |
| ***E04C 3/00*** | (2006.01) |

(52) U.S. Cl.

CPC ..... *E04C 3/04* (2013.01); *E04B 1/2403* (2013.01); *E04C 3/005* (2013.01); *E04B 2001/2406* (2013.01); *E04C 2003/0417* (2013.01); *E04C 2003/0465* (2013.01)

(58) Field of Classification Search

CPC .... E04C 3/04; E04C 3/005; E04C 2003/0417; E04C 2001/2406; E04C 2003/0465; E04B 1/2403

USPC ..... 211/126.11, 126.12, 188

See application file for complete search history.

(56) References Cited

U.S. PATENT DOCUMENTS

| | | | | |
|---|---|---|---|---|
| 1,252,816 A * | 1/1918 | Kuehl | A47B 87/02 312/107 |
| 2,801,752 A * | 8/1957 | Jakubowski | A47B 81/005 211/49.1 |
| 3,517,828 A * | 6/1970 | Hunter | A47B 87/0215 211/194 |
| 4,099,626 A * | 7/1978 | Magnussen, Jr. | A47B 63/02 211/194 |

(Continued)

FOREIGN PATENT DOCUMENTS

| | | |
|---|---|---|
| CN | 203568300 | 4/2014 |
| DE | 202010008589 | 12/2010 |
| FR | 2917105 | 12/2008 |

OTHER PUBLICATIONS

XSF System (https://www.xsftruss.com/stacking-rig-points/)—originally viewed on Oct. 23, 2019, Total 4 Pages.

*Primary Examiner* — Patrick J Maestri
(74) *Attorney, Agent, or Firm* — DLA Piper LLP (US)

(57) ABSTRACT

An example of support member is provided. The support member includes a plurality of elongated members connected to form a first elongated rigid structure. In addition, the support member includes a first elongated member of the plurality of elongated members disposed proximate to a first edge of the first elongated rigid structure with a first member top surface. The support member further includes a first stacking guide disposed on the first elongated member wherein a first attachment top surface is to slope toward the first member top surface. Also, the support member includes a second elongated member of the plurality of elongated members disposed proximate to a second edge of the first elongated rigid structure with a second member top surface. The second edge is opposite the first edge. The support member also includes a second stacking guide disposed on the second elongated member.

15 Claims, 20 Drawing Sheets

(56) References Cited

U.S. PATENT DOCUMENTS

| | | | | |
|---|---|---|---|---|
| 4,423,913 | A * | 1/1984 | Lee | A47B 87/0276 211/194 |
| 4,644,628 | A | 2/1987 | Coppa | |
| 5,402,608 | A | 4/1995 | Chu | |
| 6,079,178 | A | 6/2000 | Fisher | |
| 6,935,075 | B2 | 8/2005 | Sherman | |
| 7,347,030 | B2 | 3/2008 | Lewison | |
| 8,757,641 | B2 | 6/2014 | Gross | |
| 10,155,527 | B2 | 12/2018 | Hossler et al. | |
| 10,512,326 | B2 * | 12/2019 | Reyes | A47B 47/0091 |
| 2011/0272277 | A1 * | 11/2011 | Potchen | C25B 9/73 204/278.5 |
| 2016/0374483 | A1 * | 12/2016 | Maldonado | A47B 61/04 312/122 |
| 2019/0315568 | A1 | 10/2019 | Grove et al. | |

* cited by examiner

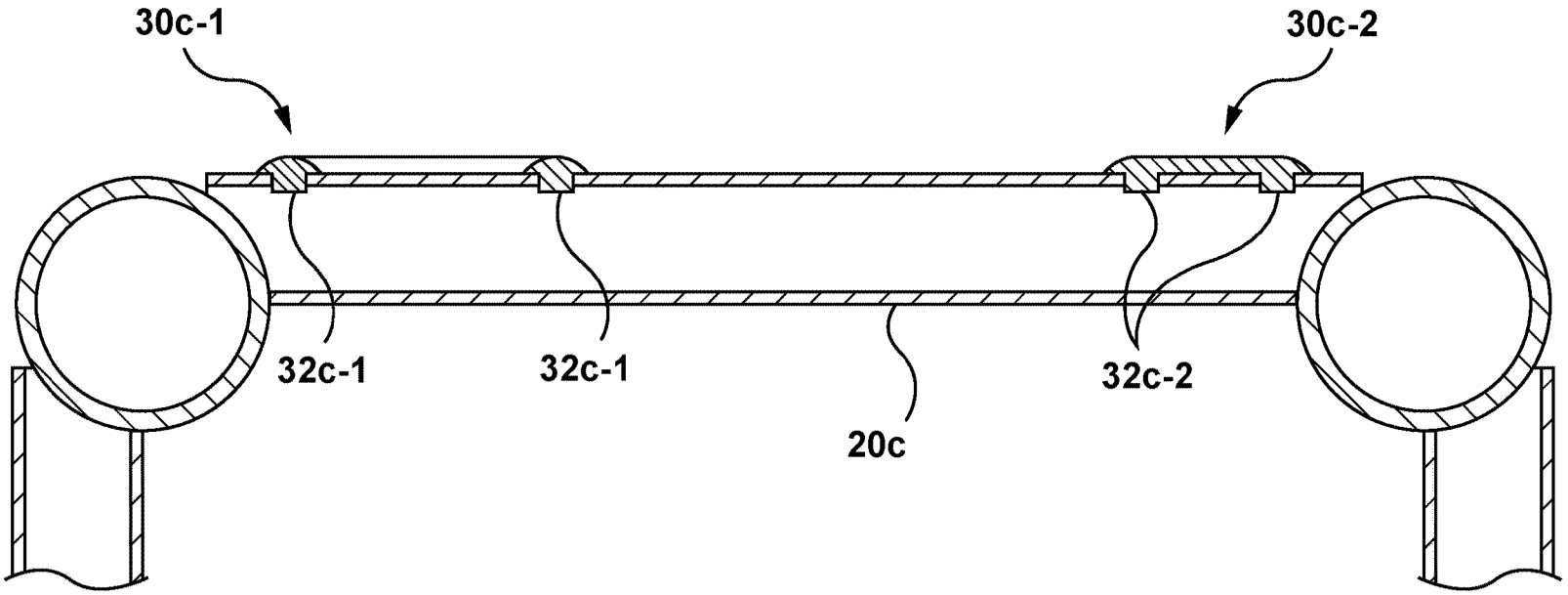
FIG. 16A
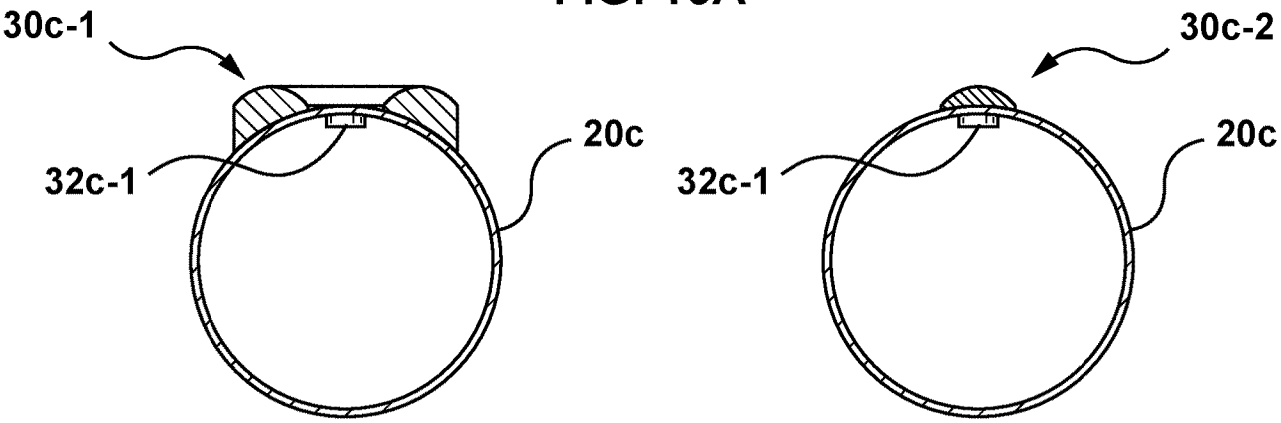
FIG. 16C
FIG. 16B

STACKING GUIDES

BACKGROUND

Stages are often used in the entertainment industry and may be platforms or other areas where a performer may perform an act, such as a live theater play, a musical recital, a lecture, or other performance for entertainment or informational purposes. Modern stages are designed to provide an audience positioned around the stage with a clear view of a performer on the stage. In addition, stages may have associated peripheral devices mounted on various support member above and around the stage to generate effects to enhance the performance carried out on stage. Such peripheral devices may include lighting fixtures as well as speakers and other devices such as pyrotechnic equipment, fog machines, mirrors, and other props.

BRIEF DESCRIPTION OF THE DRAWINGS

Reference will now be made, by way of example only, to the accompanying drawings in which:

FIG. 16A is a cross sectional view of a portion of the support member along plane 16*a*-16*a* of FIG. 15;

FIG. 16B is another cross sectional view of a portion of the support member along plane 16*b*-16*b* of FIG. 15; and FIG. 16C is another cross sectional view of a portion of the support member along plane 16*c*-16*c* of FIG. 15 in a mated position.

DETAILED DESCRIPTION

Figure 1:
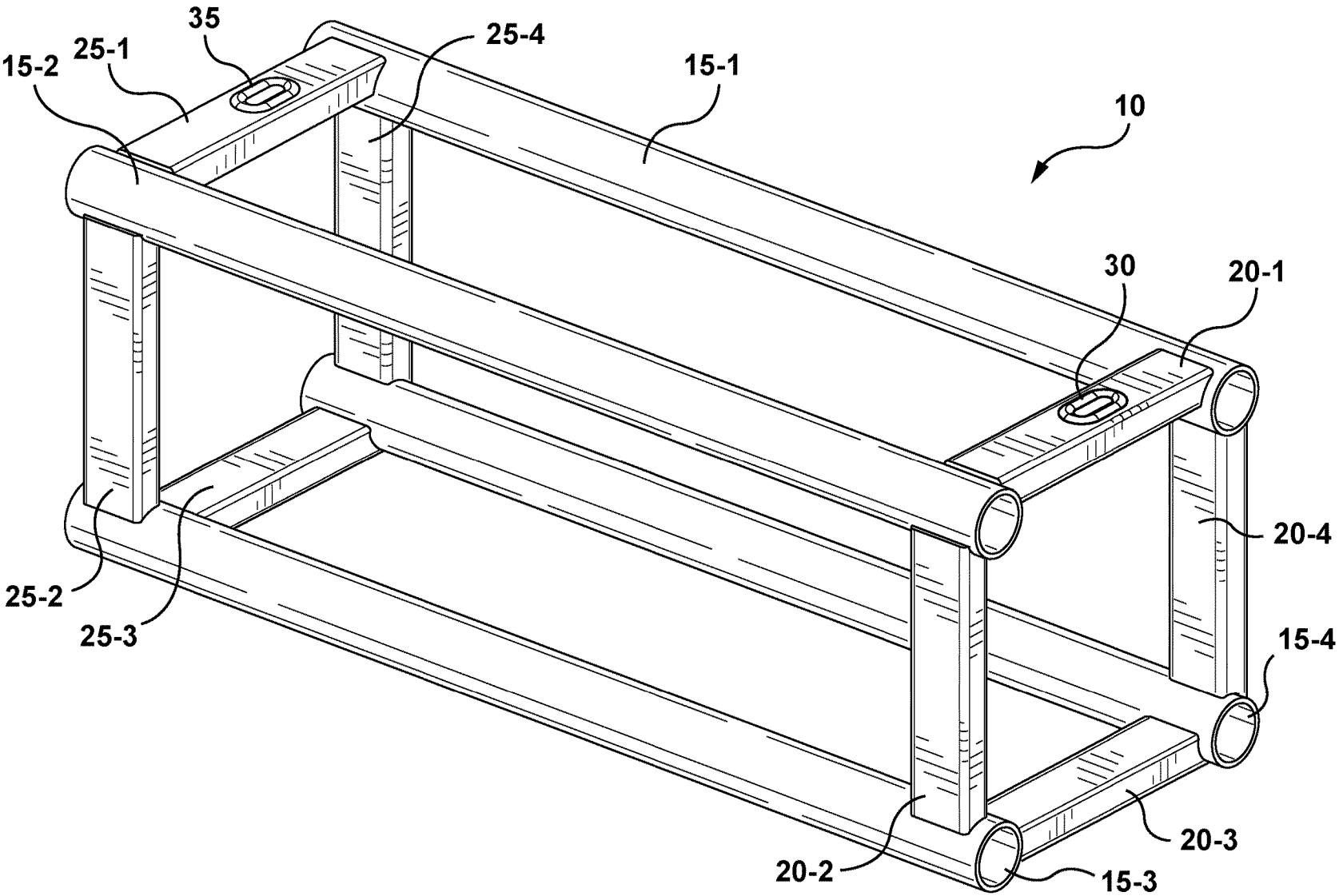
FIG. 1 is a perspective view of an example support member to support equipment above a stage.

As used herein, any usage of terms that suggest an absolute orientation (e.g. "top", "bottom", "up", "down", "left", "right", etc.) may be for illustrative convenience and refer to the orientation shown in a particular figure. However, such terms are not to be construed in a limiting sense as it is contemplated that various components will, in practice, be utilized in orientations that are the same as, or different than those described or shown.

Modern stages for performances, such as plays, concerts or lectures, may use multiple devices to provide sound and visual effects for the performance. Sound effects may include generating background music, or amplifying sound from on the stage. Visual effects may include lighting and laser effects. Additional effects such as pyrotechnic displays and fog machines may be also used. Some of the equipment used to provide the sound and visual effects are to be positioned above and beside the stage to improve the generated effect. For example, a light or laser source may be positioned above the stage so that light may be directed at the stage during a performance from above to achieve an appropriate lighting effect.

Equipment positioned above or around a stage may be placed at a specific location based on a set design for the performance. In addition, the equipment may be placed at a position above the stage at varying heights and at relative positions. In order to mount and secure equipment above a stage or near a stage, a support member, such as a truss, may be positioned above the stage. The support member may be part of a structure that is to be built above and around the stage from which various pieces of equipment may be mounted. The complexity of such a structure is not particularly limited and may involve assembling and connecting multiple support members. For example, the structure may include a single support member spanning across a stage secured to a wall or other existing structure. The support member may be positioned at a fixed location above the stage in such examples. Furthermore, the structure may include multiple connected support members in different positions and orientations to provide greater flexibility on the amount an positioning of equipment about and above the stage.

Many performances performed on a stage move from venue to venue. Accordingly, the structure used to support the equipment may be assembled and disassembled frequently and moved from venue to venue with the performance. In other examples, the structure may be leased or rented to different events such that the structure is to be disassembled between each performance. Once disassembled, the structure may include multiple pieces to be transported together. In order to efficient transport the pieces, the pieces are often organized and stacked together in order to increase the efficient of space occupied.

A support member capable of stacking other support members thereon is provided. The support member includes stacking guides to guide a second support member to a position above the original support member. For example, if multiple support members have substantially similar dimensions, or share a dimension, such as a width and/or length, the support member may be used to align additional support members placed above. By aligning the support members as they are stacked, the use of space may be more efficient to allow more support members to be placed within a confined space, such as in a shipping container or transport truck.

Referring to FIG. 1, a support member 10 to support equipment above a stage is provided. The support member 10 may be configured to be suspended above the stage or beside the stage during a performance. The equipment to be supported by the support member 10 is not particularly limited and may include various stage equipment (not shown) to generate sound and visual effects. The equipment may be either pre-mounted or partially pre-mounted to the support member 10 to provide for fast setup at a location where the stage is to be built. Alternatively, the support member 10 may be free of equipment to reduce its weight which may facilitate the setup about the stage. The manner by which the support member 10 is supported above or near the stage is not particularly limited. The support member 10 may be supported with various structures such as additional trusses, beams, pillars, other support members, or other temporary structures used to build the stage. In other examples, the support member 10 may be secured to permanent fixtures such as a building, wall, or a natural feature where the stage is to be built. In the present example, the support member 10 includes a plurality of elongated members 15-1, 15-2, 15-3, 15-4 (generically, these elongated members are referred to herein as "elongated member 15", and collectively they are referred to as "elongated members 15", this nomenclature is used elsewhere in this description), another plurality of elongated members 20-1, 20-2, 20-3, 20-4 (generically, these elongated members are referred to herein as "elongated member 20", and collectively they are referred to as "elongated members 20", this nomenclature is used elsewhere in this description), another plurality of elongated members 25-1, 25-2, 25-3, 25-4 (generically, these elongated members are referred to herein as "elongated member 25", and collectively they are referred to as "elongated members 25", this nomenclature is used elsewhere in this description), and stacking guides 30 and 35.

Figure 2A:
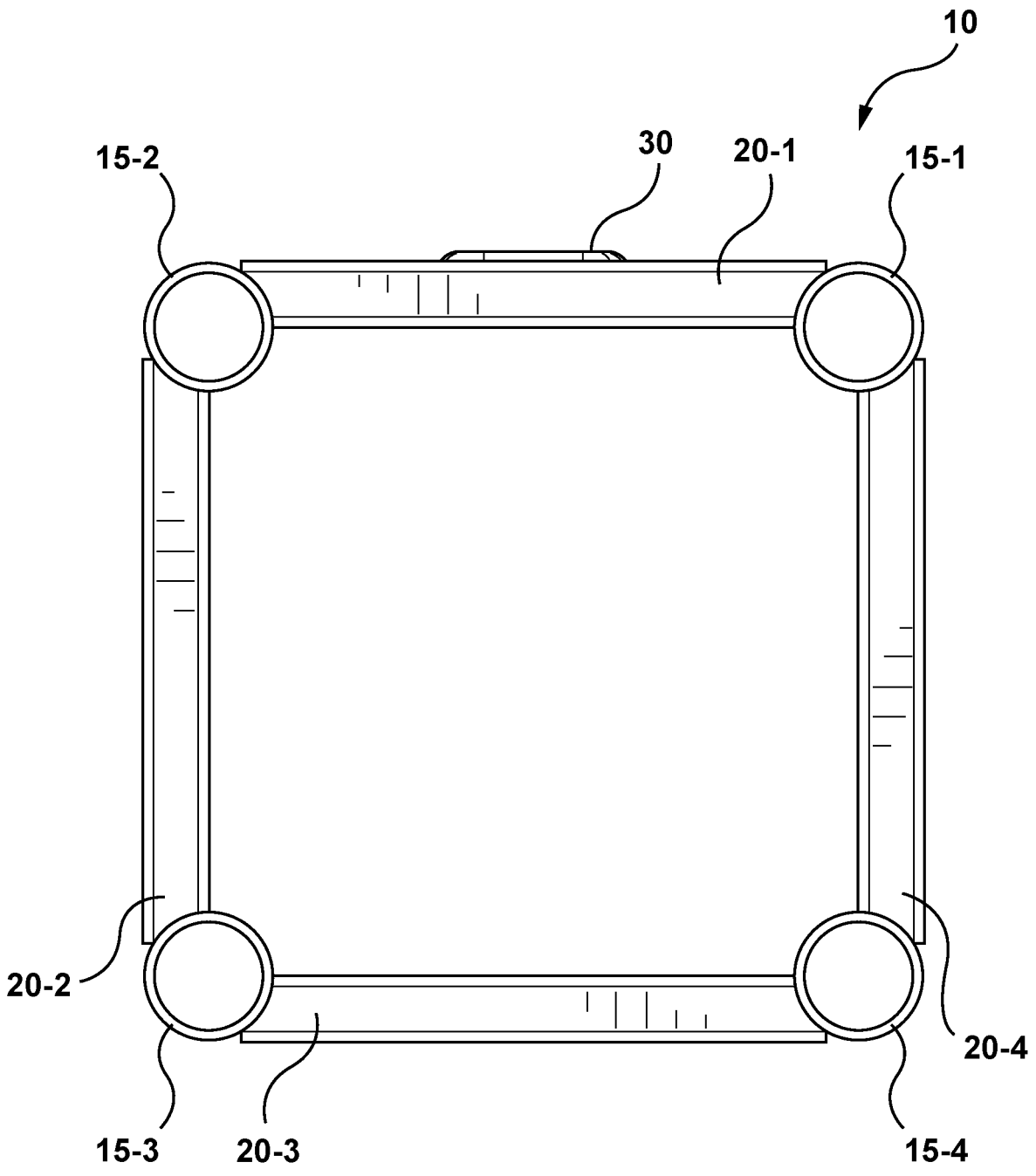
FIG. 2A is an end view of the support member of FIG. 1.
Figure 2B:
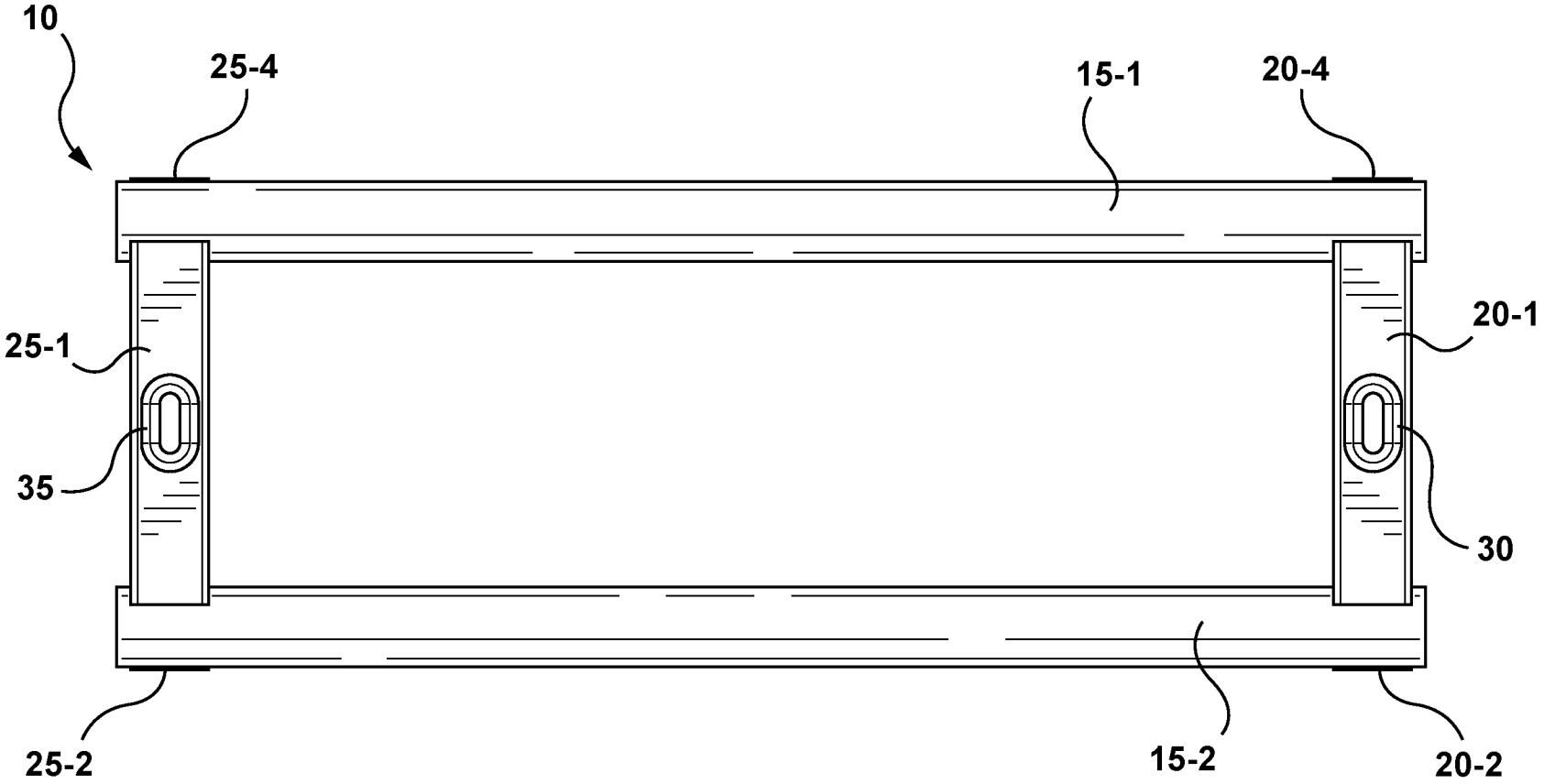
FIG. 2B is a top view of the support member of FIG. 1.
Figure 2C:
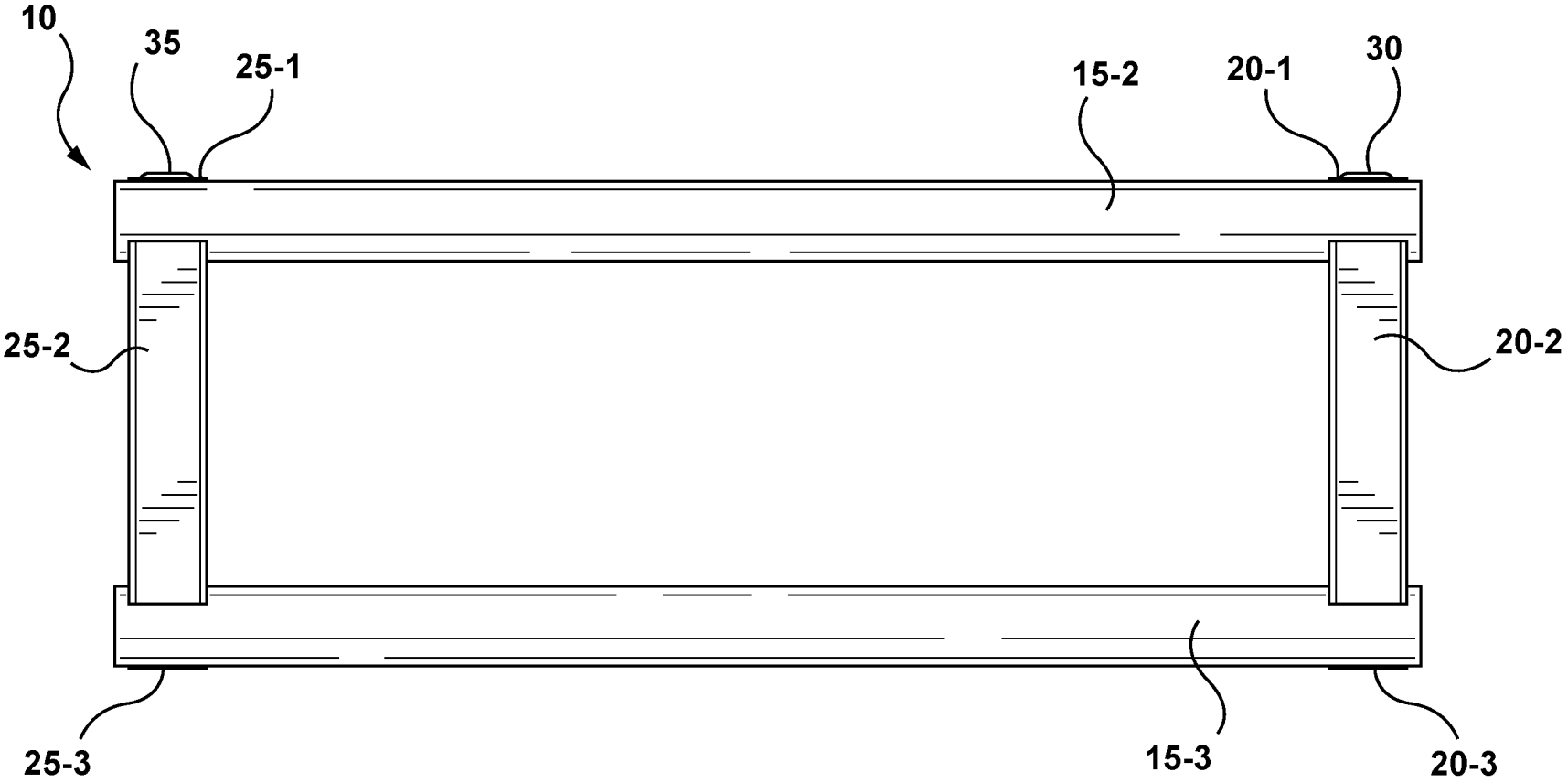
FIG. 2C is a side view of the support member of FIG. 1.

Referring to FIGS. 2A, 2B, and 2C, the end, top, and side views of the the support member 10, respectively. In the present example, the elongated members 15, 20, and 25 are generally connected to form a structure to support equipment at a predetermined position above or beside a stage. In particular, the elongated members 15, 20, and 25 are connected to form a rigid structure. The manner by which the elongated members 15, 20, and 25 are connected to each other is not limited. In the present example, the elongated members 15, 20, and 25 are welded together to form the rigid structure. In other examples, the elongated members 15, 20, and 25 may be glued together with adhesives or fastened together using fasteners such as bolts, rivets, or screws. In further examples, the elongated members 15, 20, and 25 may be friction fitted or molded as a unitary piece. In the present example, the rigid structure is formed in an elongated shape and may be used to provide mechanical structure and attachment points to which equipment (not shown) may be mounted. It is to be appreciated by a person of skill in the art with the benefit of this description that the rigid structure is not particularly limited and may be one of many different configurations of elongated members 15, 20, and 25 depending on the weight of equipment to be supported as well as the complexity of the structure to be used.

In the present example, the elongated member 20-1 is disposed proximate to an edge of the structure of the support member 10. The elongated member 20-1 is generally shaped with a substantially flat surface on the top as illustrated in the figures. It is to be appreciated by a person of skill in the art with the benefit of this description that the top surface of the elongated member 20-1 may be used to interact with a portion of another support member to be stacked thereon. In the present example, it is contemplated that the second support member is includes an elongated structure similar to the rigid structure of the support member 10. Accordingly, the flat surface of the elongated member 20-1 may provide stability for stacking by supporting the additional support member. It is to be appreciated that in other examples, the elongated member 20-1 may have other shapes, such as a curved surface on top.

The support member 10 further includes the elongated member 25-1 disposed proximate to an opposite edge of the rigid structure of the support member 10. In the present example, the elongated member 20-1 and the elongated member 25-1 are at opposite lengthwise ends as shown in FIG. 1. Similar to the elongated member 20-1, the elongated member 25-1 is generally shaped with a substantially flat surface on the top as illustrated in the figures. It is to be appreciated by a person of skill in the art with the benefit of this description that the top surface of the elongated member 25-1 may be used to interact with a portion of the rigid structure of another support member to be stacked thereon. It is to be appreciated that in other examples, the elongated member 25-1 may also have other shapes, such as a curved surface on top.

In the present example, the elongated member 20-1 and the elongated member 25-1 are positioned to engage the rigid structure of another support member of similar size placed thereon. As there are at least two points of contact, one on the elongated member 20-1 and the other on the elongated member 25-1, the weight of the additional support member placed above the support member 10 may be distributed among different points on the support member 10. Therefore, the stress on each of the elongated member 20-1 and the elongated member 25-1 is reduced. Furthermore, additional contact may also be made with the elongated members 15-1 and 15-2 with corresponding members of the rigid structure of the additional support member placed above.

The stacking guide 30 is to be disposed on the elongated member 20-1. The stacking guide 30 is not particularly limited and it is to be appreciated that different mechanisms and designs are contemplated. In general, the stacking guide 30 is to guide an attachment point of the second elongated rigid structure to be positioned above the support member 10 such that an end of the support member placed above may be substantially aligned in the proximity of the stacking guide 30. The manner by which the stacking guide 30 guides the additional support member is not particularly limited. In the present example, the stacking guide 30 may have a top surface slope toward the surface of the elongated member 20-1. Accordingly, in this example, the slope may be designed to position a protrusion or boss on the rigid structure of another support member with gravity. In particular, the stacking guide 30 may be a ring and the slope may guide the protrusion or boss to the center of the ring. In other examples, the stacking guide 30 may use other mechanisms, such as magnetic or electromagnetic forces, to position the rigid structure of the support member placed above the support member 10.

Figure 3A:
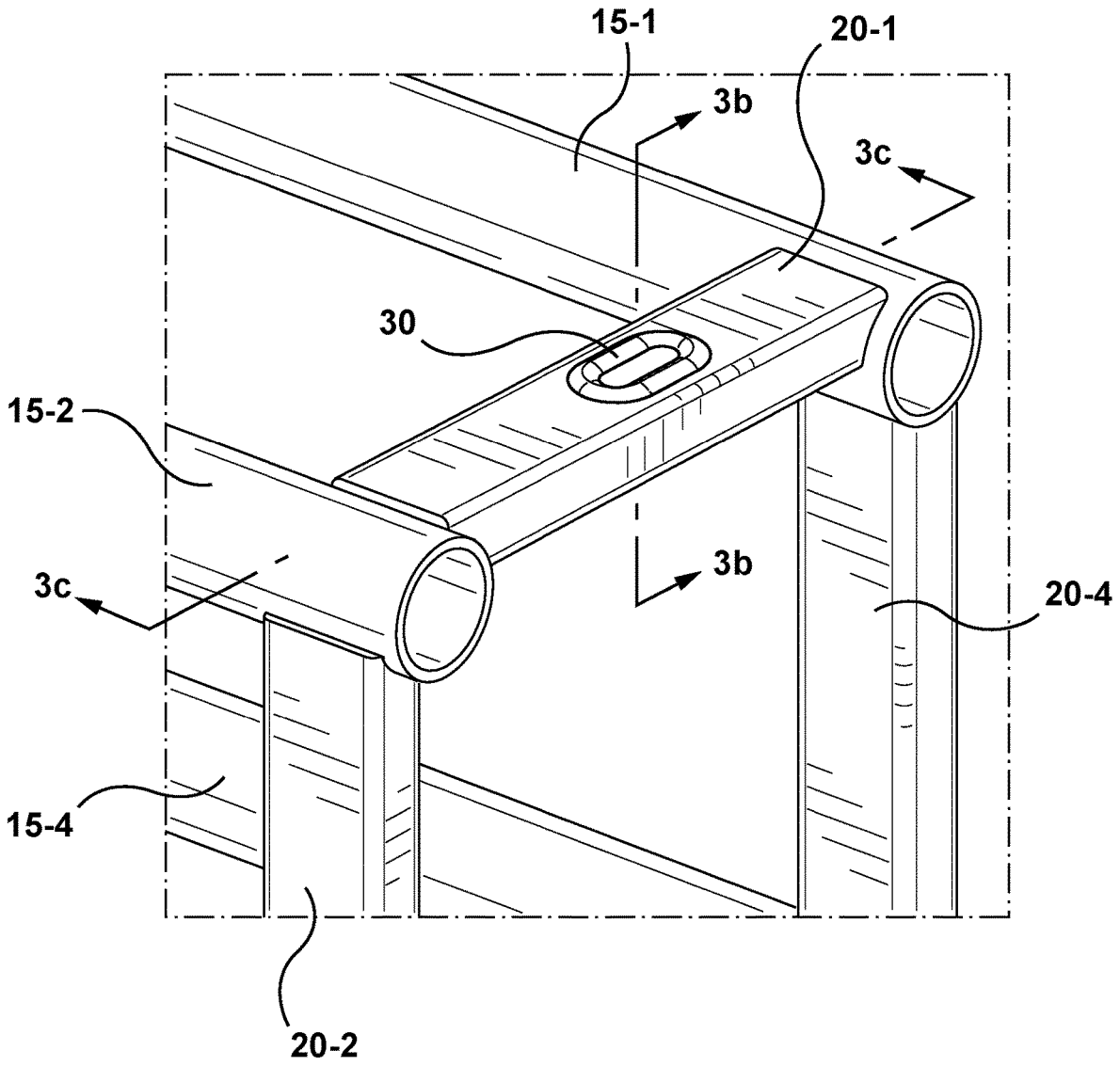
FIG. 3A is zoomed in view of an end of the support member of FIG. 1.
Figure 3B:
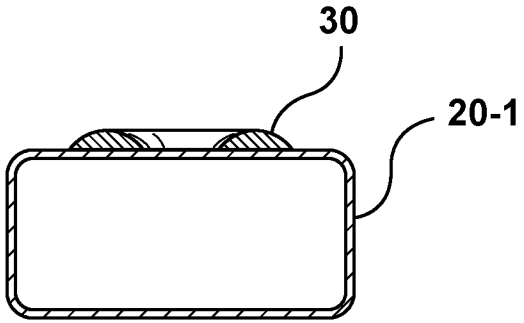
FIG. 3B is a cross sectional view of a portion of the support member along plane 3*b*-3*b* of FIG. 1.
Figure 3C:
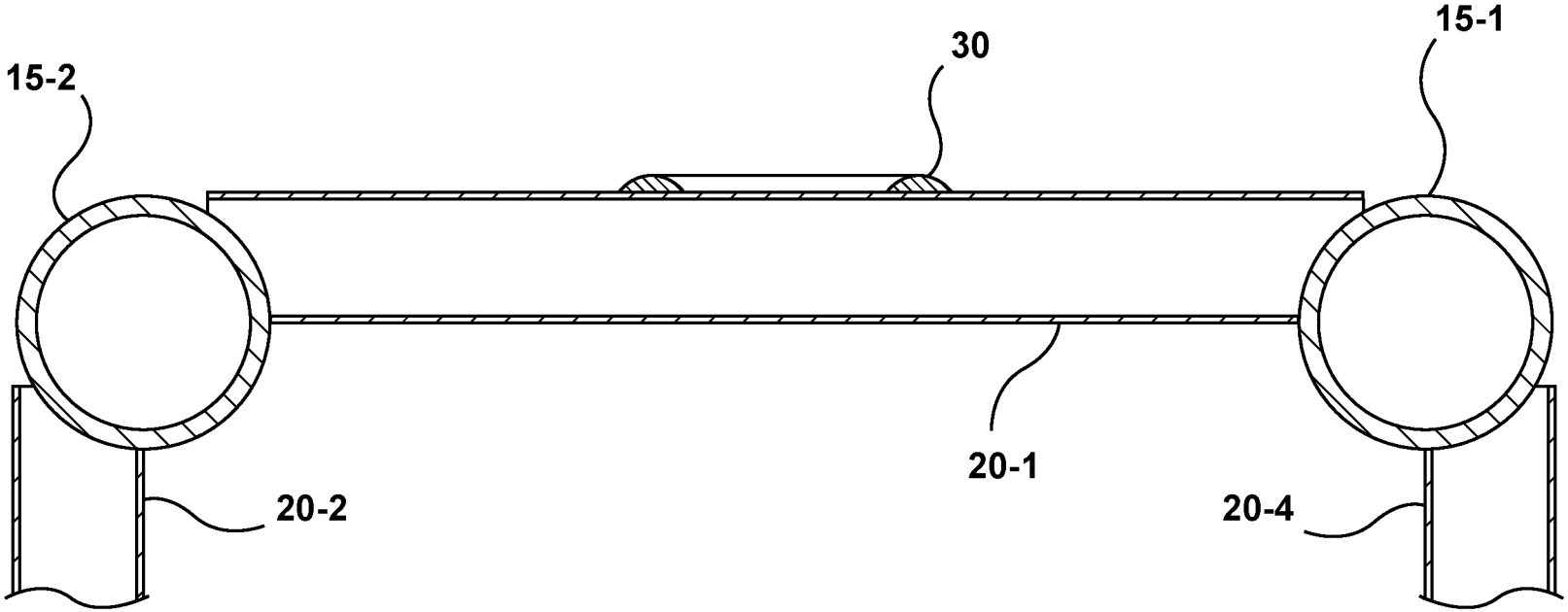
FIG. 3C is another cross sectional view of a portion of the support member along plane 3*c*-3*c* of FIG. 1.

Referring to FIG. 3A, a closer view of the stacking guide 30 is shown. In addition, FIGS. 3B and 3C show a cross sectional of the stacking guide 30. In this example, the stacking guide 30 is attached to the surface of the elongated member 20-1. It is to be appreciated by a person of skill with the benefit of this description that the manner by which the stacking guide 30 is attached to the elongated member 20-1 is not particularly limited. For example, the stacking guide 30 may be attached using an adhesive substance, such as epoxy. In other examples, the stacking guide 30 may include a magnet to engage the elongated member 20-1 if it is made from a ferromagnetic material, such as steel, or vice versa. In other examples, the stacking guide 30 may be fastened to the elongated member 20-1 using a fastener, such as a bolt, screw, nut, pin, or rivet. As another example, the stacking guide 30 may be welded or soldered to the elongated member 20-1. In further examples, the stacking guide 30 may be formed as part of the elongated member 20-1 using a molding, etching or printing process.

As shown in FIGS. 3B and 3C, the stacking guide 30 includes a surface that slopes toward the surface of the elongated member 20-1. Accordingly, a protrusion or other feature configured to engage the stacking guide 30 may slide over the stacking guide 30 by travelling up and over the stacking guide 30. It is to be appreciated that in this example, the stacking guide 30 provides a barrier to hold an attachment point, such as the protrusion within a defined boundary while at the same time allowing the attachment point to be dislodged from the stacking guide relatively easily when the support members are to be separated. To further assist with the movement of the support member 10 and the support member placed thereon relative to each other, the top surface of the stacking guide 30 and/or the surface of the elongated member 20-1 may be smooth to reduce sliding friction relative to each other to provide for easier sliding. In other examples, a lubricant may also be used to further reduce friction. Accordingly, the stacking guide 30 when complemented with an appropriate attachment point, such as a protrusion with a complementary shape, provides an over-center mechanism to hold the attachment point above the stacking guide 30. In this example, upon sliding the protrusion to the top of the stacking guide 30, the downward slope guides the protrusion to a location within the boundary of the stacking guide 30 with the force of gravity. The height and steepness of the slope of the stacking guide 30 relative to the elongated member 20-1 is not limited and may depend on the weight of the additional support member and/or the desired force to dislodge the additional support member from the support member 10. As the height and/or angle of the stacking guide 30 increase, the amount of force to engage or disengage the support members with a lateral force increases while the two supporting member are held in place better to avoid shifting or accidental separation during transport.

In the present example, the stacking guide 30 is to be made from a substantially hard material that is not easily deformed by the weight of the additional support member placed above support member 10. It is to be appreciated by a person of skill with the benefit of this description that the stacking guide 30 is not limited to any specific type of material and that several different types of materials are contemplated. In general, the stacking guide 30 is to be sufficiently hard and rigid to withstand lateral forces such that the stacking guide 30 may prevent lateral movement of the protrusion or boss resting within the boundaries of the stacking guide 30. The materials from which the stacking guide 30 may be made include metal, such as steel or aluminum, wood, plastic, or composite materials. In some examples, the stacking guide 30 may include a combination of different types of materials.

The stacking guide 35 is to be disposed on the elongated member 25-1 at the opposite end of the rigid structure from the stacking guide 30. The stacking guide 35 may be substantially similar to the stacking guide 30. In other examples, the stacking guide 35 may be different from the stacking guide 30. In general, the stacking guide 35 is to guide another attachment point of the second elongated rigid structure to be positioned above the support member 10 such that the support member placed above may be substantially aligned. The manner by which the stacking guide 35 guides the additional support member is not particularly limited and may be operate in a similar manner as the stacking guide 30. For example, the stacking guide 35 may similarly have a top surface slope toward the surface of the elongated member 25-1. The slope may be designed to position a second protrusion or boss on the rigid structure of the support member placed above the support member 10 with gravity. In other examples, the stacking guide 35 may use magnetic or electromagnetic forces to position the rigid structure of the support member placed above the support member 10.

Similar to the stacking guide 30, the stacking guide 35 is to be made from a substantially hard material that is not easily deformed by the weight of the additional support member placed above support member 10. It is to be appreciated by a person of skill with the benefit of this description that the stacking guide 35 is not limited to any specific type of material and that several different types of materials are contemplated such as the materials discussed above in connection with the stacking guide 30.

Although the present example contemplates stacking substantially a similar sized support member directly on top of the support member 10, it is to be appreciated by a person of skill with the benefit of this description that it is not limited. For example, other stacking configurations are contemplated there support members may be staggered or stacked perpendicularly in adjacent layers. In other examples, the support members may also be of different lengths such that the ends of the support members may not line up.

Figure 4:
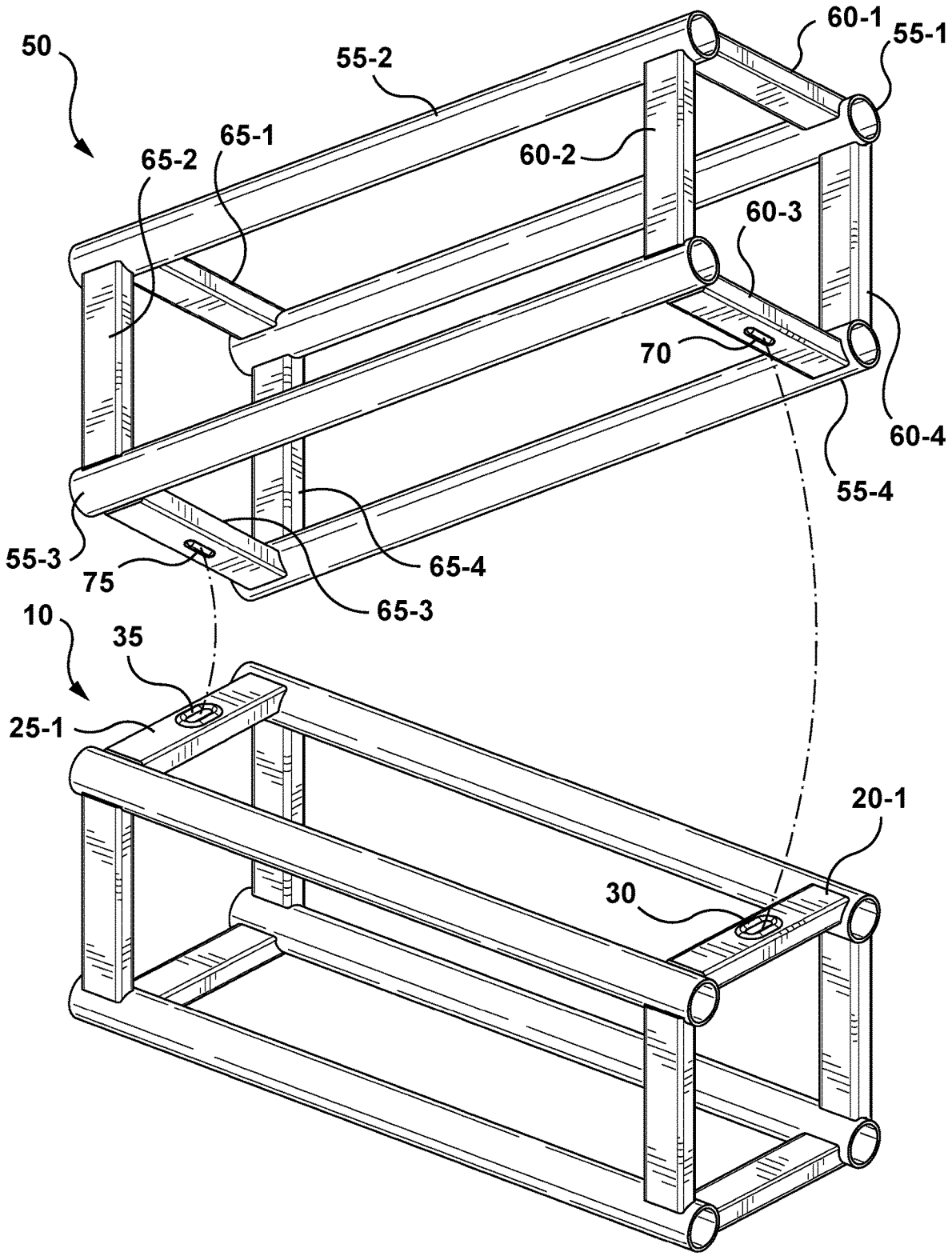
FIG. 4 is a perspective view of the support member of FIG. 1 interacting with another support member.

Referring to FIG. 4, a second support member 50 is shown to be stacked on the support member 10. In the present example, the support member 50 may be substantially similar to the support member 10 in terms of providing support to equipment above a stage. Furthermore, during the assembly of a structure about a stage, the support member 50 may be connected to other support members, such as the support member 10, in a lengthwise manner to form a longer support structure. However, during transportation or storage, the support member 50 may be stacked on top of the support member 10 to use space more efficiently within a container or on a transport vehicle.

In the present example, the support member 50 includes a plurality of elongated members 55-1, 55-2, 55-3, 55-4 (generically, these elongated members are referred to herein as "elongated member 55", and collectively they are referred to as "elongated members 55", this nomenclature is used elsewhere in this description), another plurality of elongated members 60-1, 60-2, 60-3, 60-4 (generically, these elongated members are referred to herein as "elongated member 60", and collectively they are referred to as "elongated members 60", this nomenclature is used elsewhere in this description), another plurality of elongated members 65-1, 65-2, 65-3, 65-4 (generically, these elongated members are referred to herein as "elongated member 65", and collectively they are referred to as "elongated members 65", this nomenclature is used elsewhere in this description), and attachment points 70 and 75.

The elongated members 55, 60, and 65 are used to provide a structure to support equipment at a predetermined position above or beside a stage and function similar to the elongated members 15, 20, and 25 of the support member 10 to form a rigid structure. In the present example, the rigid structure formed by the elongated members 55, 60, and 65 may be substantially identical in structure to that of the support member 10. Accordingly, when deployed above a stage, the support member 50 may be interchangeable with the support member 10 in some case. In other examples, the support member 50 may include additional elongated members or features to accommodate specialized equipment. It is to be appreciated by a person of skill in the art with the benefit of this description that the rigid structure of the support member 50 is not particularly limited and may be one of many different configurations depending on the weight of equipment to be supported as well as the complexity of the overall structure above the stage.

In the present example, the elongated member 60-3 is disposed proximate to an edge of the structure of the support member 50. The elongated member 60-3 is generally shaped with a substantially flat surface on the bottom of the support member 50. It is to be appreciated by a person of skill in the art with the benefit of this description that the bottom surface of the elongated member 60-3 may be used to interact with the top surface of the elongated member 20-1 of the support member 10. Although the elongated member 60-3 includes a flat bottom surface in the present example, it is to be appreciated that in other examples, the elongated member 60-3 may have a curved surface or irregularly shaped surface on the bottom.

The support member 50 further includes the elongated member 65-3 disposed proximate to an opposite edge of the rigid structure of the support member 50. In the present example, the elongated member 60-3 and the elongated member 65-3 are at opposite lengthwise ends. Similar to the elongated member 60-3, the elongated member 65-3 is generally shaped with a substantially flat surface on the bottom. It is to be appreciated by a person of skill in the art with the benefit of this description that the bottom surface of the elongated member 65-3 may be used to interact with the top surface of the elongated member 25-1 of the support member 10.

As there are at least two points of contact, one between the elongated member 60-3 and the elongated member 20-1 and the other between the elongated member 65-3 and the elongated member 25-1, the weight of the support member 50 placed above the support member 10 may be distributed between the two points to reduce the stress on each of the elongated member 20-1 and the elongated member 25-1. Furthermore, additional contact may also be made with the elongated members 15-1 and 15-2 with elongated members 55-4 and 55-3 of the support member 50, respectively.

The attachment point 70 is to be disposed on the bottom of the elongated member 60-3. The attachment point 70 is not particularly limited and various mechanisms and designs to mate with the stacking guide 30 are contemplated. In the present example, the stacking guide 30 may have a top surface slope toward the surface of the elongated member 20-1. The slope may be designed to position the attachment point 70 of the support member 50 with gravity. In particular, the attachment point 70 is a protrusion extending from the bottom surface of the elongated member 65-3 such that once the attachment point 70 passes the highest point of the stacking guide 30, the attachment point 70 is guided to a centered position within the boundaries of the stacking guide 30.

In the present example, the attachment point 70 is to be made from a substantially hard material that is not easily deformed by the weight of the support member 10. In the present example, the attachment point 70 may be made from the same materials as the stacking guide 30 discussed above. It is to be appreciated by a person of skill with the benefit of this description that the stacking guide 30 and the attachment point 70 may be interchanged in some examples. In the present example, the stacking guide 30 is a closed shape, such as an oval shaped ring, into which the attachment point 70 fits. Accordingly, the oval shaped ring is to hold the attachment point 70 in place to restrict lateral movement. In other examples, the attachment point 70 may be a closed shape into which the stacking guide 30 fits.

The attachment point 75 is to be disposed on the elongated member 65-3 at the opposite end of the rigid structure from the attachment point 70. The attachment point 75 may be substantially similar to the attachment point 70. In other examples, the attachment point 75 may be different from the attachment point 70. In general, the attachment point 75 is to interact and mate with the stacking guide 35 of the support member 10 such that the support member 50 may be substantially aligned above the support member 10. The manner by which the attachment point 75 interacts with the stacking guide 35 is not particularly limited and may be similar to the manner by which the attachment point 70 interacts with the stacking guide 30.

Similar to the attachment point 70, the attachment point 75 is to be made from a substantially hard material that is not easily deformed by the weight of the support member 50 placed above support member 10. It is to be appreciated by a person of skill with the benefit of this description that the attachment point 75 is not limited to any specific type of material and that several different types of materials are contemplated such as the materials discussed above in connection with the attachment point 70.

In the present example, as the attachment point 70 and the attachment point 75 approach the stacking guide 30 and the stacking guide 35, respectively, the stacking guide 30 is to guide the attachment point 70 to a predetermined location, and the stacking guide 35 is to guide the attachment point 75 to another predetermined location. It is to be appreciated that the predetermined locations to which the attachment point 70 and the attachment point 75 are guided is not particularly limited. In this example, the predetermined locations are selected to align the support member 50 substantially directly over the support member 10.

In the present example, the stacking guide 30 and the stacking guide 35 may be shaped to mate with the attachment point 70 and the attachment point 75. The stacking guide 30 and the stacking guide 35 are substantially similar oval shaped rings and the attachment point 70 and the attachment point 75 are substantially similar oval shaped protrusions with dimensions to fit within the stacking guide 30 and the stacking guide 35, respectively. Accordingly the weight of the support member 50 may cause the stacking guide 30 and the stacking guide 35 to guide the attachment point 70 and the attachment point 75, respectively, to the center of the oval shaped rings. It is to be appreciated that the stacking guide 30 and the stacking guide 35 are not particularly limited by shape. In other examples, instead of being closed ovals, the stacking guide 30 and the stacking guide 35 may be open shapes to confine the movement of the attachment point 70 and the attachment point 75, respectively, by contacting opposite ends of the protrusions. In other examples, the shape of the stacking guide 30 and the stacking guide 35 may be another shape to mate with the attachment point 70 and the attachment point 75.

Figure 5A:
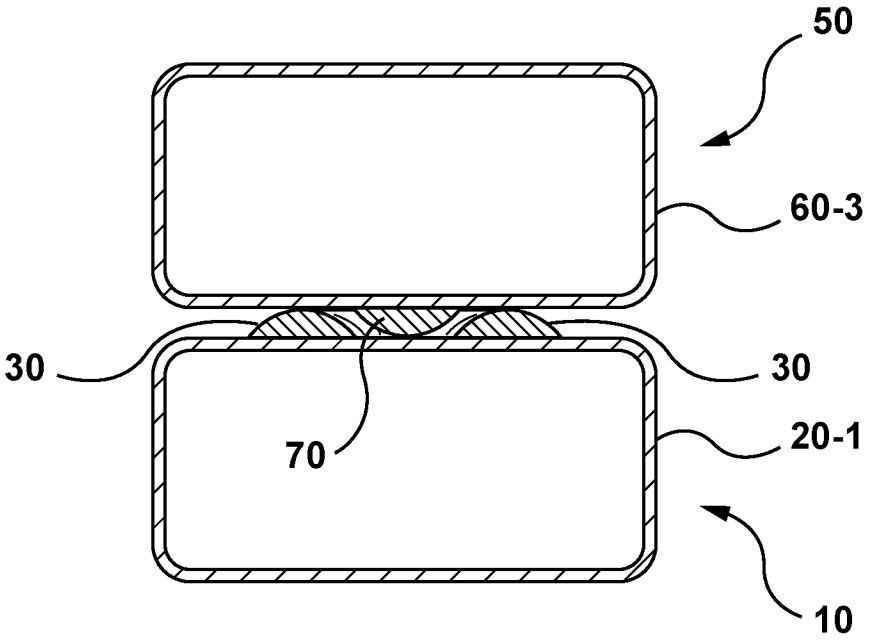
FIG. 5A is a cross sectional view of a portion of the support members shown in FIG. 4 in a mated position.
Figure 5B:
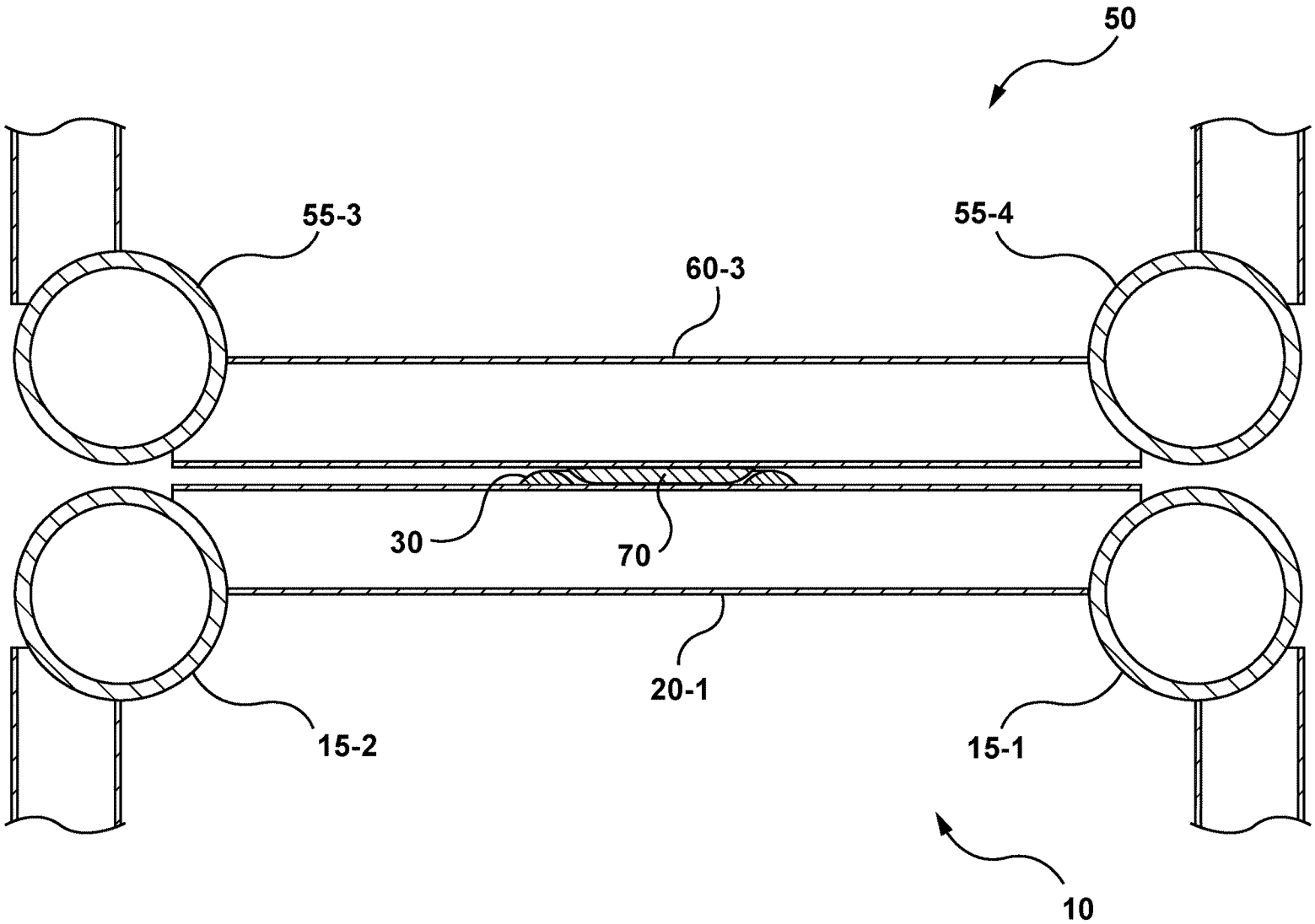
FIG. 5B is a cross sectional view of a portion of the support members shown in FIG. 4 in a mated position.

Referring to FIGS. 5A and 5B, a cross section of the mating of the stacking guide of the support member 50 and the attachment point 70 of the support member 10 is shown. In this example, the stacking guide 30 includes a top surface that slopes toward the surface of the elongated member 20-1. Accordingly, the attachment point 70 configured to engage the stacking guide 30 may slide over the stacking guide 30 by travelling up along a slope of the stacking guide 30, over the top of the stacking guide 30, and down another slope on the other side to the center of the stacking guide 30. It is to be appreciated that in this example, the stacking guide 30 provides a barrier to hold the attachment point 70 within a predetermined location defined by the boundary of the stacking guide 30 while at the same time allowing the attachment point 70 to be dislodged from the stacking guide 30 relatively easily when the support member 50 is to be separated from the stacking configuration above the support member 10. To further assist with the movement of the support member 10 and the support member 50, the top surface of the stacking guide 30 and/or the surface of the elongated member 20-1 may be smooth to reduce sliding friction with the attachment point 70. In this example, the attachment point may be held in place at the center of the stacking guide by the boundary of the stacking guide 30 with the force of gravity. However, if the support member 50 is to be removed from above the support member 10, a sufficient lateral force on the support member 10 may be used to cause the attachment point 70 to move in the opposite direction over the boundary of the stacking guide 30 to become dislodged. The support member 50 may then be continued to be push until the support member 50 falls off the support member 10.

Figure 6:
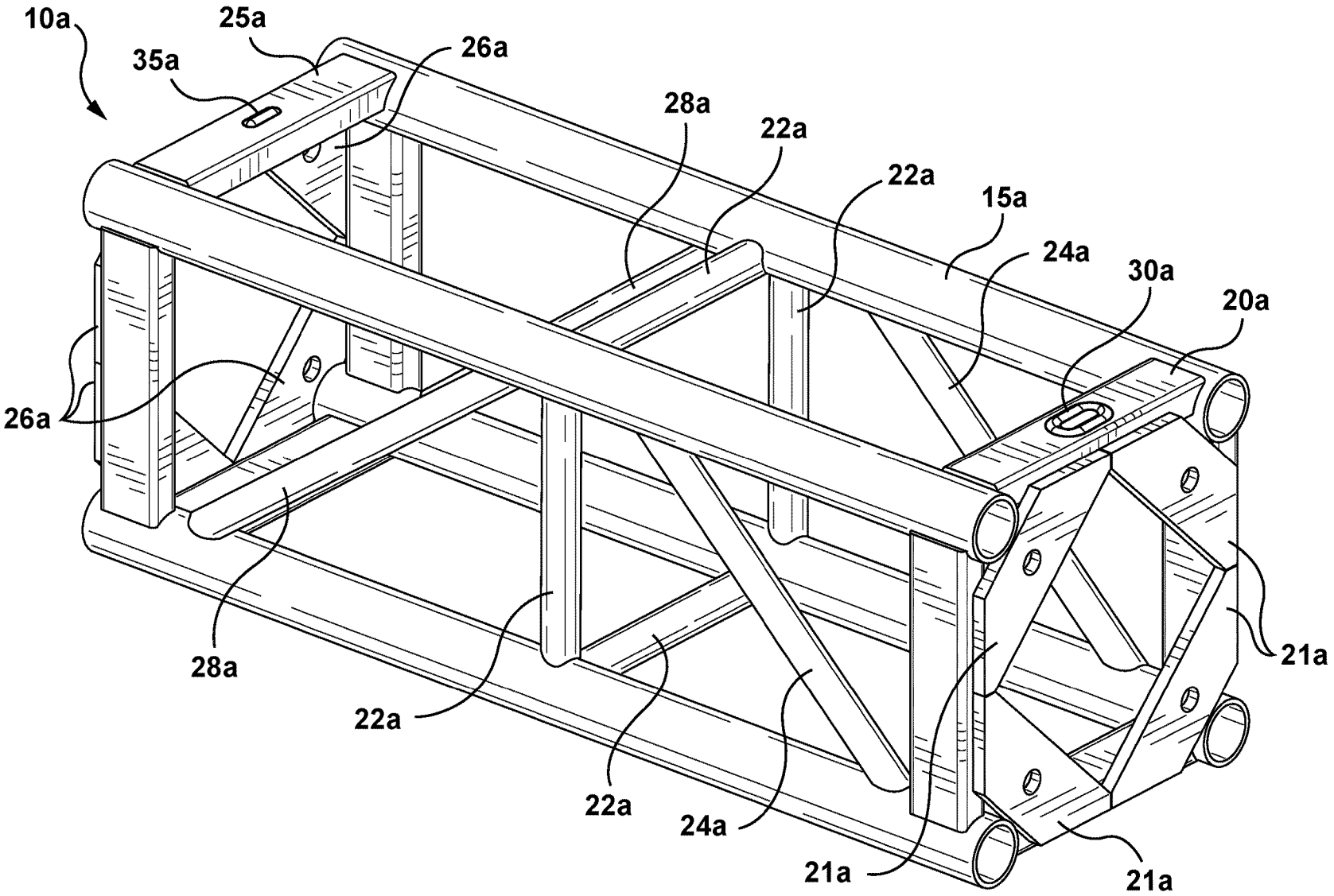
FIG. 6 is a perspective view of another example support member to support equipment above a stage.

Referring to FIG. 6, support member 10*a* to support equipment above a stage is provided. Like components of the support member 10*a* bear like reference to their counterparts in the support member 10, except followed by the suffix "a". The support member 10*a* may be configured to be suspended above the stage or beside the stage during a performance. The equipment to be supported by the support member 10*a* is not particularly limited and may include various stage equipment (not shown) to generate sound and visual effects. In the present example, the support member 10*a* includes a plurality of elongated members 15*a*, a plurality of elongated members 20*a*, a plurality of elongated members 21*a*, a plurality of elongated members 22*a*, a plurality of elongated members 24*a*, a plurality of elongated members 25*a*, a plurality of elongated members 26*a*, a plurality of elongated members 28*a*, a stacking guide 30*a*, and stacking guide 35*a*.

It is to be appreciated by a person of skill in the art with the benefit of this description that the elongated members 15*a*, 20*a*, 21*a*, 22*a*, 24*a*, 25*a*, 26*a*, and 28*a* are connected to form a truss structure. In particular, the elongated members 15*a*, 20*a*, 21*a*, 22*a*, 24*a*, 25*a*, 26*a*, and 28*a* provide the support member 10*a* with rigidity such that heavy equipment may be attached at a location above or near the stage. In the present example, the elongated members 15*a*, 20*a*, 21*a*, 22*a*, 24*a*, 25*a*, 26*a*, and 28*a* are not particularly limited and may be each substantially similar. In other examples, some of the elongated members 15*a*, 20*a*, 21*a*, 22*a*, 24*a*, 25*a*, 26*a*, and 28*a* may be different sizes and/or made from different materials depending on the expected load. Furthermore, the truss structure of the support member 10*a* may be modified to add addition elongated members to increase the structural rigidity. Similarly, the truss structure of the support member 10*a* may be modified to omit some of the elongated members to simplify the design and assembly process.

Figure 7:
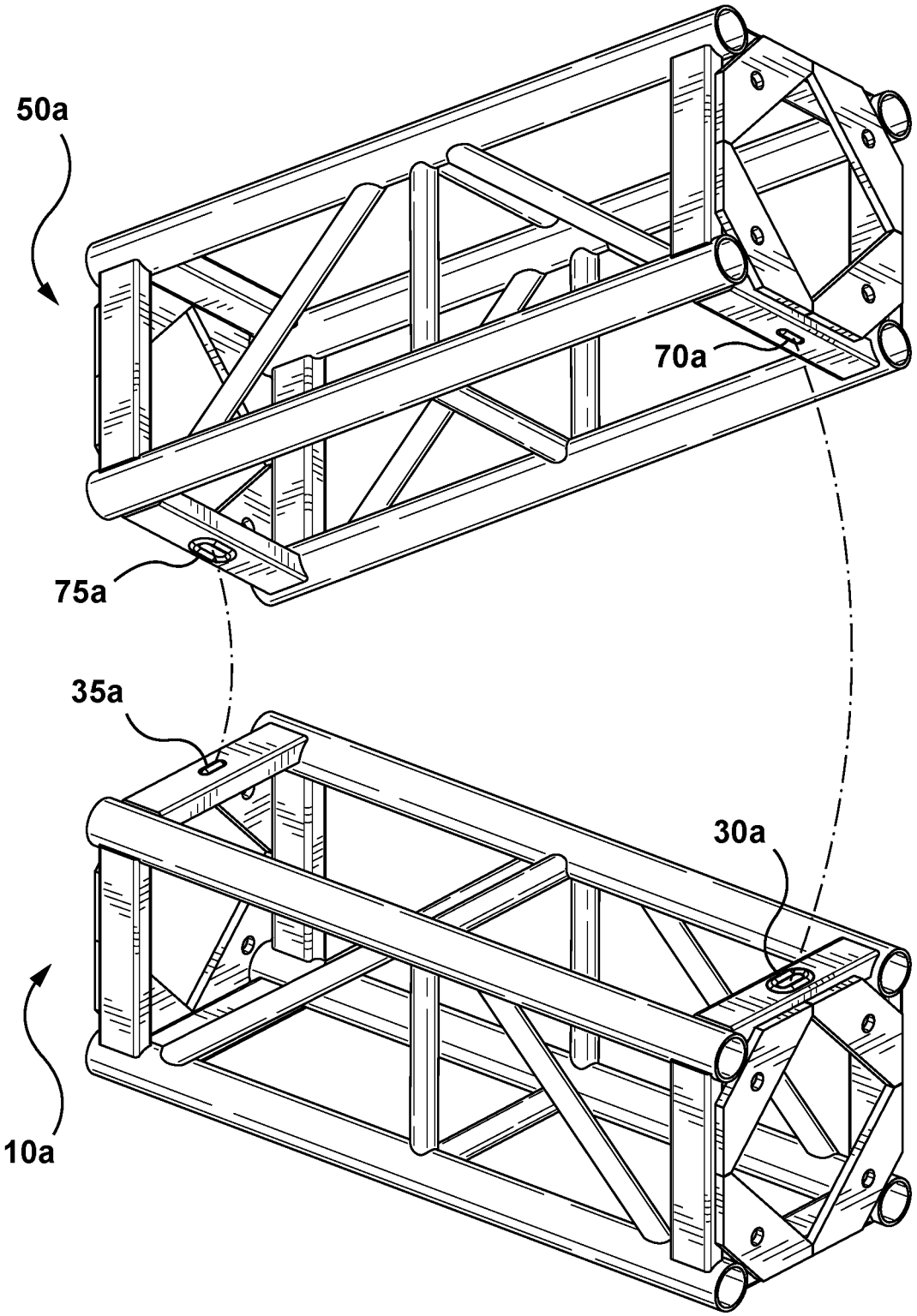
FIG. 7 is a perspective view of the support member of FIG. 6 interacting with another support member.

Referring to FIG. 7, a second support member 50*a* is shown to be stacked on the support member 10*a*. In the present example, the support member 50*a* may be substantially similar to the support member 10*a* in terms of providing support to equipment above a stage. Furthermore, during the assembly of a structure about a stage, the support member 50*a* may be connected to other support members, such as the support member 10 in a lengthwise manner to form a longer support structure. However, during transportation or storage, the support member 50*a* may be stacked on top of the support member 10*a* to use space more efficiently.

In the present example, the stacking guide 30*a* is different from the stacking guide 35*a*. The stacking guide 30*a* is to mate with the attachment point 70*a*. Similarly, the stacking guide 35*a* is to mate with the attachment point 75*a*. Accordingly, the stacking guide 30*a* is to be incompatible with the attachment point 75*a* and the stacking guide 35*a* is to be incompatible with the attachment point 70*a*. Therefore, in examples where the support member 50*a* includes no additional attachment points, the stacking guide 30*a* and the stacking guide 35*a* permit the structure of the support member 50*a* to be aligned with the support member 10*a* in a single orientation.

The stacking guide 30*a* may be substantially similar to the stacking guide 30 describe above. In particular, stacking guide 30*a* may be an oval shaped ring and the attachment point 70*a* may be a substantially similar oval shaped protrusion with dimensions to fit within the stacking guide 30*a*. The stacking guide 35*a* may be a substantially oval shaped protrusion and the attachment point 75*a* may be a substantially similar oval shaped ring with dimensions to fit around the stacking guide 30*a*. It is to be appreciated that the stacking guide 30*a* may be substantially similar to the attachment point 75*a* and the stacking guide 35*a* may be substantially similar to the attachment point 70*a*. In other examples, the shape of the stacking guide 30*a* and the stacking guide 35*a* may be other shapes to mate with the attachment point 70*a* and the attachment point 75*a*, respectively, each having a different, but complementary shape.

Accordingly, the support members 10*a* and 50*a* may be designed to accommodate a specific stacking order. For example, the support member 10*a* and the support member 50*a* may include features, such as a mounting point for equipment or pre-mounted with equipment that may use space such that the support member 50*a* is to be stacked in an orientation that may accommodate equipment protruding from the support member 10*a* and vice versa. In addition, the stacking orientation may also be used to facilitate assembly in examples where the support members are to be assembled in a specific orientation by having the support member 50*a* oriented in the correct manner to avoid flipping the support member 50*a* prior to assembly.

Figure 8:
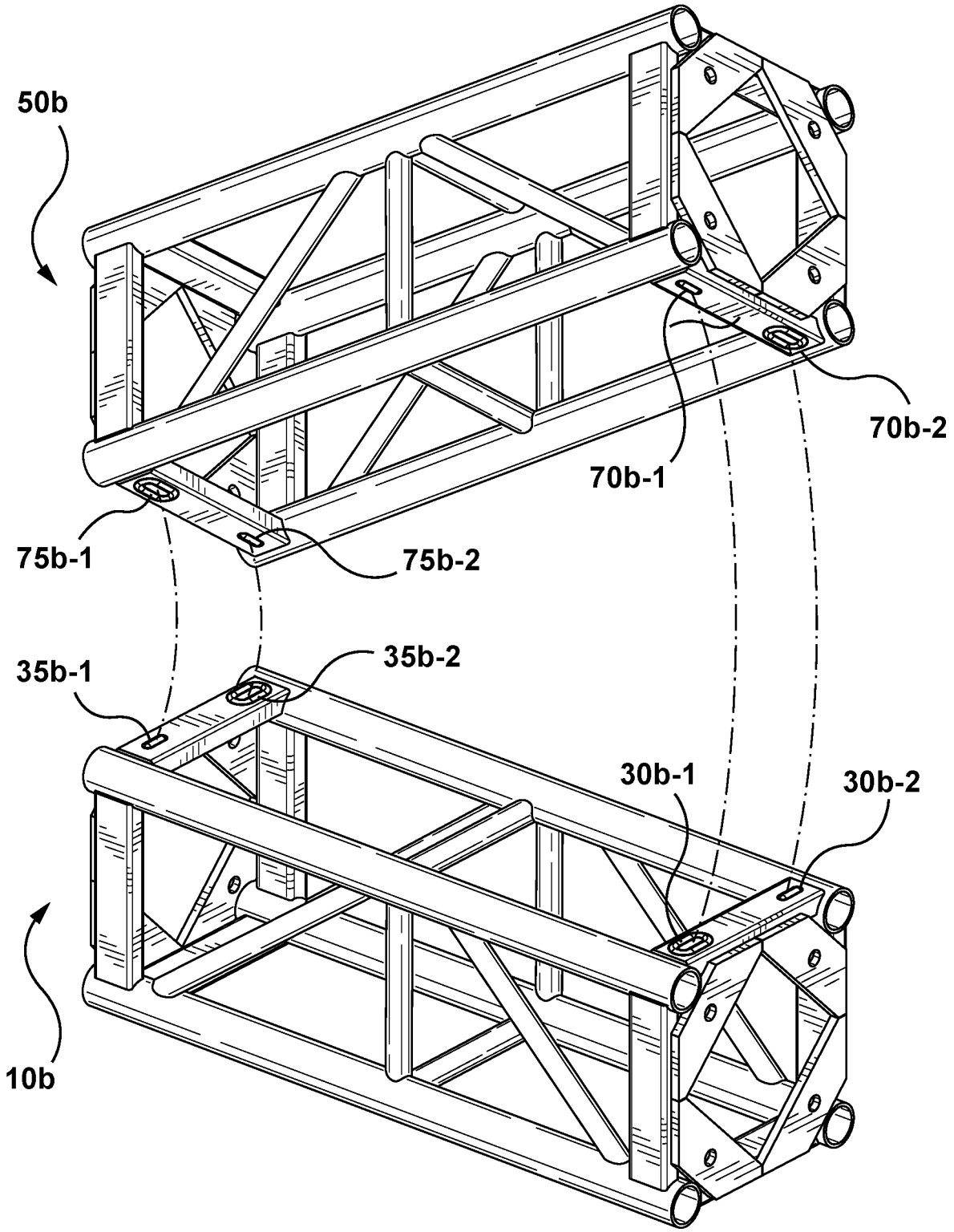
FIG. 8 is a perspective view of another support member interacting with an additional support member.
Figure 9A:
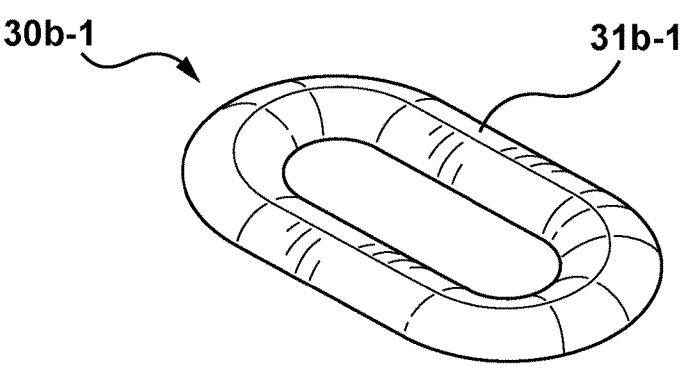
FIG. 9A is a top perspective view of an example stacking guide.
Figure 9B:
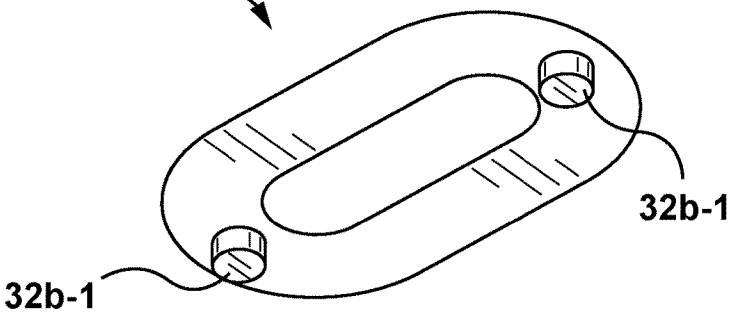
FIG. 9B is a bottom perspective view of the stacking guide of FIG. 9A.
Figure 9C:
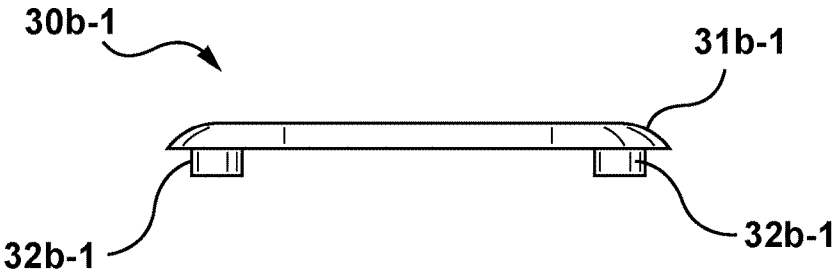
FIG. 9C is a side view of the stacking guide of FIG. 9A.
Figure 9D:
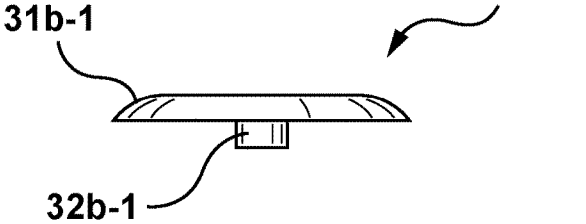
FIG. 9D is an end view of the stacking guide of FIG. 9A.
Figure 9E:
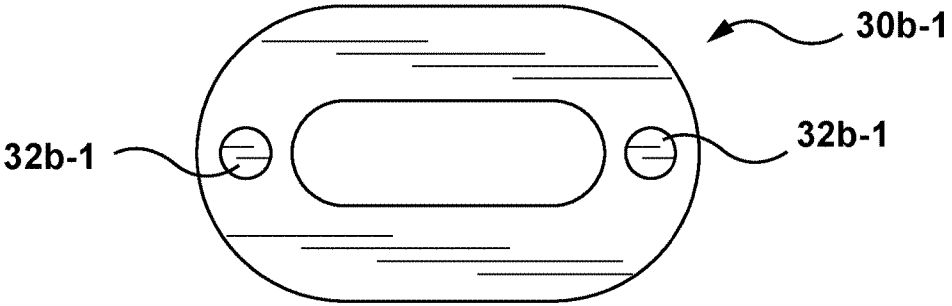
FIG. 9E is a bottom view of the stacking guide of FIG. 9A.
Figure 10B:
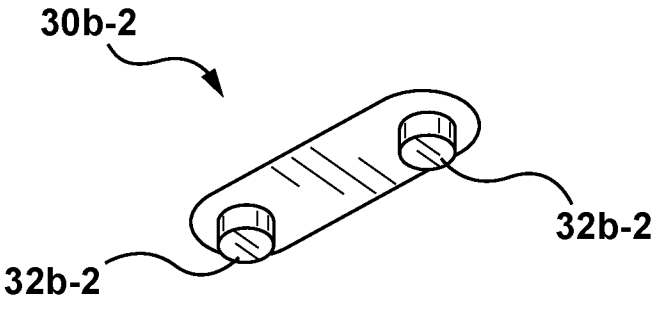
FIG. 10B is a bottom perspective view of the stacking guide of FIG. 10A.
Figure 10A:
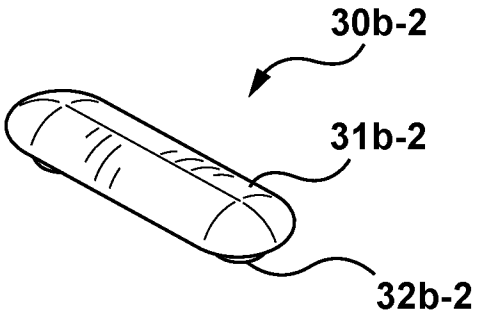
FIG. 10A is a top perspective view of another example stacking guide.
Figure 10D:
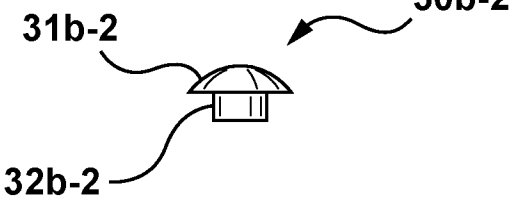
FIG. 10D is an end view of the stacking guide of FIG. 10A.
Figure 10C:
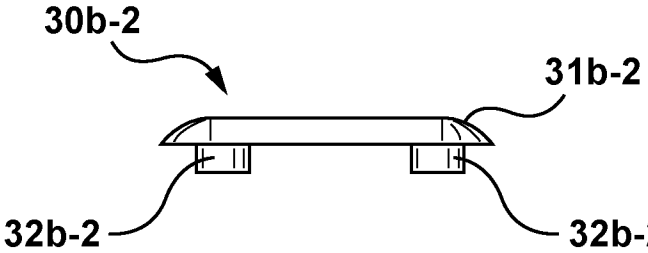
FIG. 10C is a side view of the stacking guide of FIG. 10A.
Figure 10E:
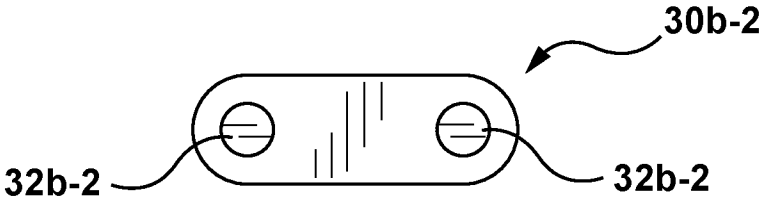
FIG. 10E is a bottom view of the stacking guide of FIG. 10A.

Referring to FIG. 8, support member 10*b* and a support member 50*b* to support equipment above a stage is provided. Like components of the support member 10*b* and the support member 50*b* bear like reference to their counterparts in the support member 10 and the support member 50, respectively, except followed by the suffix "b".

In the present example, the support member 10*a* includes stacking guides 30*b*-1 and 30*b*-2 (generically, these elongated members are referred to herein as "stacking guide 30*b*", and collectively they are referred to as "stacking guides 30*b*", this nomenclature is used elsewhere in this description), and stacking guides 35*b*-1 and 35*b*-2 (generically, these elongated members are referred to herein as "stacking guide 35*b*", and collectively they are referred to as "stacking guides 35*b*", this nomenclature is used elsewhere in this description). The support member 50*a* includes attachment points 70*b*-1 and 70*b*-2 (generically, these elongated members are referred to herein as "attachment point 70*b*", and collectively they are referred to as "attachment points 70*b*", this nomenclature is used elsewhere in this description), and attachment points 75*b*-1 and 75*b*-2 (generically, these elongated members are referred to herein as "attachment point 75*b*", and collectively they are referred to as "attachment points 75*b*", this nomenclature is used elsewhere in this description). The stacking guides 30*b* and 35*b* collectively form a base pattern on the support member to mate with the complementary pattern formed but the attachment points 70*b* and 75*b* on the bottom of the rigid structure of the support member 50*b*.

The base pattern formed by the stacking guides 30*b* and 35*b* and the complementary pattern formed by the attachment points 70*b* and 75*b* are not particularly limited. In the present example, the stacking guides 30*b* and 35*b* and the attachment points 70*b* and 75*b* are each one of two possible shapes placed in a pattern. In particular, the stacking guides 30*b*-1 and 35*b*-2 and the attachment points 70*b*-2 and 75*b*-1 may be a substantially similar oval shaped ring. The stacking guides 30*b*-2 and 35*b*-1 and the attachment points 70*b*-1 and 75*b*-2 may be a substantially similar oval shaped protrusion with dimensions to fit around the attachment points 70*b*-2 and 75*b*-1 and the stacking guides 30*b*-1 and 35*b*-2, respectively. Accordingly, in the present example shown in FIG. 8, the stacking guides 30*b*-1 and 30*b*-2 mate with the attachment points 70*b*-1 and 70*b*-2, respectively. In addition, the stacking guides 35*b*-1 and 35*b*-2 mate with the attachment points 75*b*-1 and 75*b*-2, respectively, at the opposite ends of the support members 10*b* and 50*b*.

Furthermore, it is to be appreciated that in the present example, the spacing of the stack guides 30*b* and 35*b* and the attachment points 70*b* and 75*b* are similar in size and symmetrical such that the support member 50*b* may be stacked in multiple orientations. For example, the support member 50*b* may be rotated 180° such that the stacking guides 30*b*-1 and 30*b*-2 mate with the attachment points 75*b*-2 and 75*b*-1, respectively. In addition, the stacking guides 35*b*-1 and 35*b*-2 mate with the attachment points 70*b*-2 and 70*b*-1, respectively, at the opposite ends of the support members 10*b* and 50*b*.

The base pattern and the complementary pattern in the present example may be formed with two basic shapes. Furthermore, it will be appreciated that the attachment points may be used as stacking guides for addition support members and that several support members may be stacked above each other. In particular, stacking guides may be disposed on the top side (not shown) of the support member 50*b* such that the support member 50*b* may receive another support member thereon and align the additional support member with both the support member 50*b* and the support member 10*b*. In addition, additional attachment points/stacking guides may be disposed on sides of the support member 50*b*. The additional attachment points/stacking guides may have the same base pattern or complementary pattern such that the support member 50*b* may be stacked onto of the support member 10*b* using any of the four sides.

Referring to FIGS. 9A, 9B, 9C, 9D, and 9E, various views of the stacking guide 30*b*-1 is shown in greater detail. In the present example, the stacking guide 30*b*-1 includes a top surface 31*b*-1 and pegs 32*b*-1.

The top surface 31*b*-1 is not particularly limited and is to generally engage the attachment point 70*b*-1 of the support member 50*b*. In the present example, the top surface 31*b*-1 slopes toward the surface of the elongated member 20*b*. Accordingly, in this example, the slope may be designed to position the attachment point 70*b*-1 with gravity. By supporting a substantial amount of weigh on a small area of the top surface 31*b*-1, the stacking guide 30*b*-1 may be made from a substantially hard material that is not easily deformed and that the attachment point 70*b*-1 may slide across the top surface 31*b*-1 without significantly scratching or damaging the top surface 31*b*-1.

The pegs 32*b*-1 are to interact with the elongated member 20*b* to secure the stacking guide 30*b*-1 to the elongated member 20*b* and to prevent lateral movement of the stacking guide 30*b*-1 when lateral forces are applied, such as if the attachment point 70*b*-1 is to be dragged across and over the stacking guide 30*b*-1. The pegs 32*b*-1 are not particularly limited and may be formed from a molding process to be part of a unitary body. In other examples, the pegs 32*b*-1 may be attached to the main body of the stacking guide 30*b*-1. It is to be understood that other substantially oval rings, such as the stacking guide 35*b*-2 and the attachment points 70*b*-2 and 75*b*-1 may have a similar or identical structure to the stacking guide 30*b*-1.

Referring to FIGS. 10A, 10B, 10C, 10D, and 10E, various views of the stacking guide 30*b*-2 is shown in greater detail. In the present example, the stacking guide 30*b*-2 includes a top surface 31*b*-2 and pegs 32*b*-2.

The top surface 31*b*-2 is not particularly limited and is to generally engage the attachment point 70*b*-2 of the support member 50*b*. In the present example, the stacking guide 30*b*-2 may be formed from similar or identical materials as the stacking guide 30*b*-1 and thus have similar properties as described above. Accordingly, the stacking guide 30*b*-2 may be formed from a molding process using a different mold.

It is to be understood that other substantially oval protrusions, such as the stacking guide 35*b*-1 and the attachment points 70*b*-1 and 75*b*-2 may have a similar or identical structure to the stacking guide 30*b*-2. Furthermore, stacking guides 30*b* and 35*b* as well as all attachment points 70*b* and

75*b* may be formed using two different molds: one to make oval rings and another to make oval protrusions. Although the present examples illustrate stacking guides 30*b* each having two pegs 32*b*, it is to be appreciated that the number of pegs 32*b* is not limited. In the present example, the two pegs 32*b* are to secure the stacking guides 30*b* on the elongated member 20*b* and restrict rotation on the surface. In other examples, a single peg 32*b* may be secured to the elongated member 20*b* with sufficient force to restrict rotation.

Figure 11:
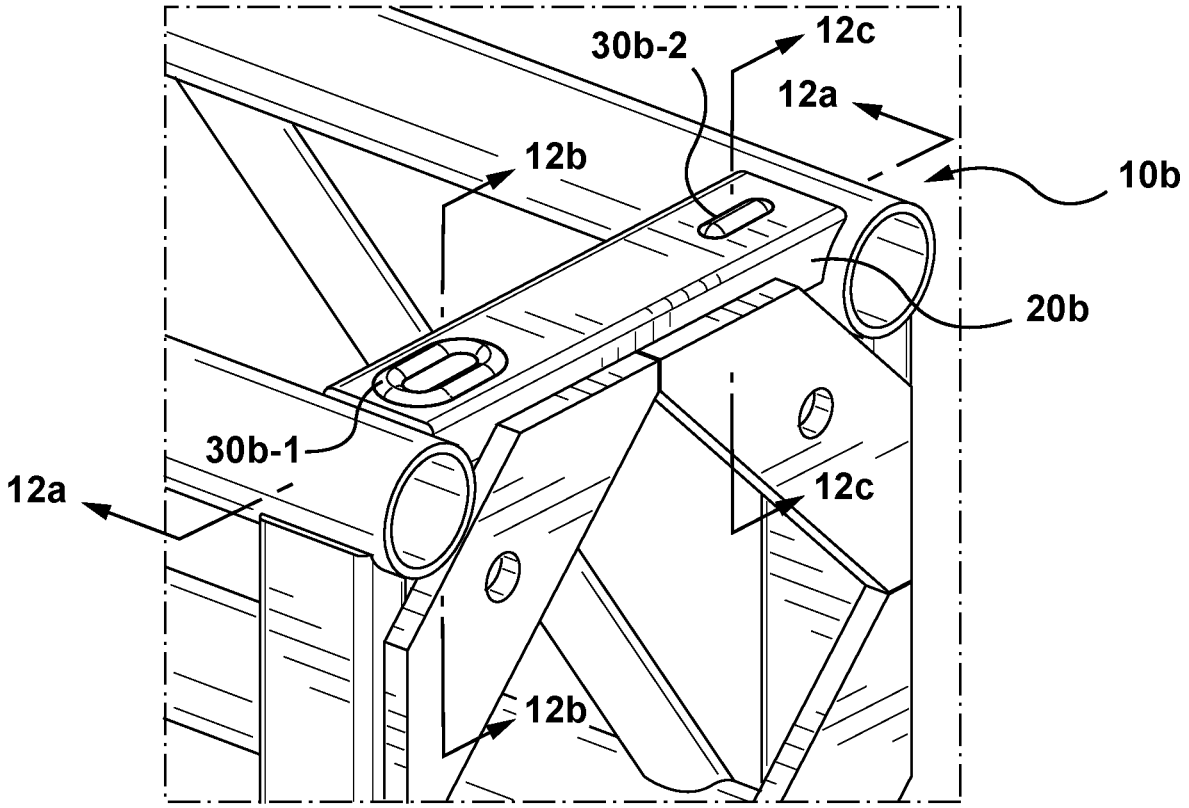
FIG. 11 is zoomed in view of an end of a support member shown in FIG. 8.
Figure 12A:
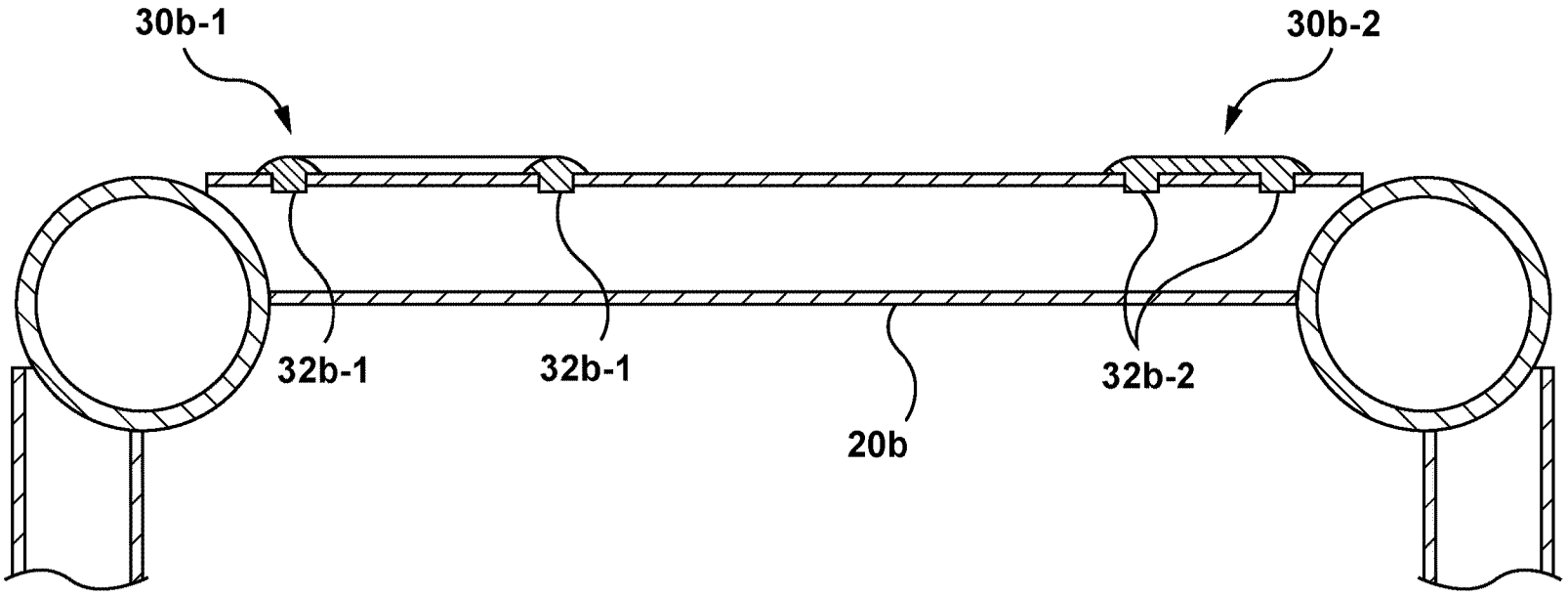
FIG. 12A is a cross sectional view of a portion of the support member along plane 12*a*-12*a* of FIG. 11.
Figure 12C:
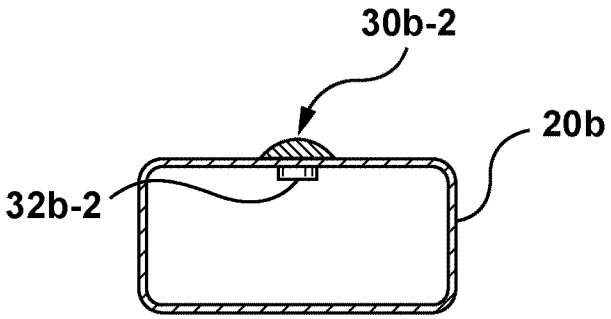
FIG. 12C is another cross sectional view of a portion of the support member along plane 12*c*-12*c* of FIG. 11 in a mated position.
Figure 12B:
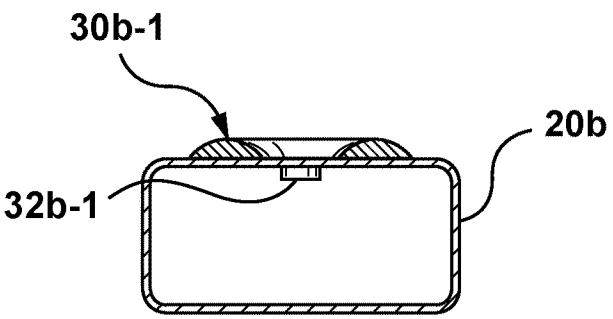
FIG. 12B is another cross sectional view of a portion of the support member along plane 12*b*-12*b* of FIG. 11.
Figure 13B:
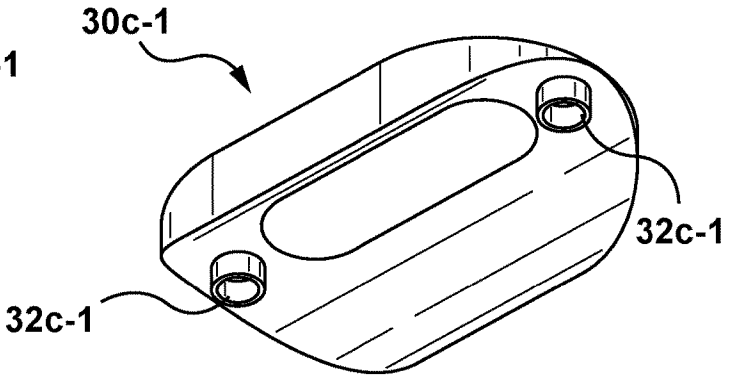
FIG. 13B is a bottom perspective view of the stacking guide of FIG. 13A.
Figure 13D:
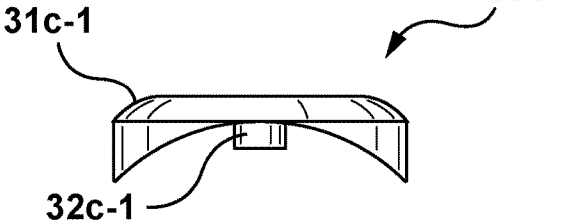
FIG. 13D is an end view of the stacking guide of FIG. 13A.
Figure 13E:
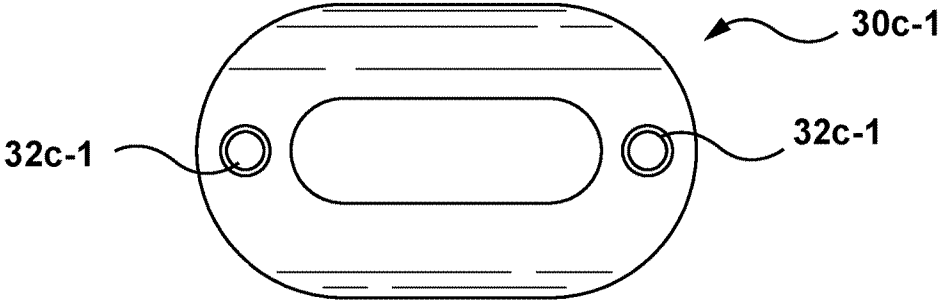
FIG. 13E is a bottom view of the stacking guide of FIG. 13A.
Figure 13A:
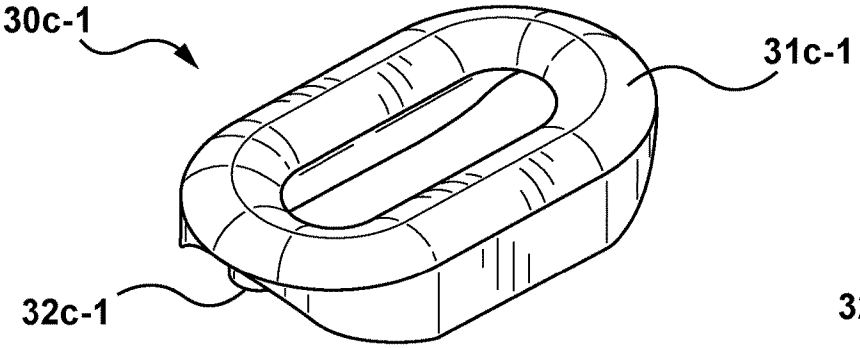
FIG. 13A is a top perspective view of another example of a stacking guide.
Figure 13C:
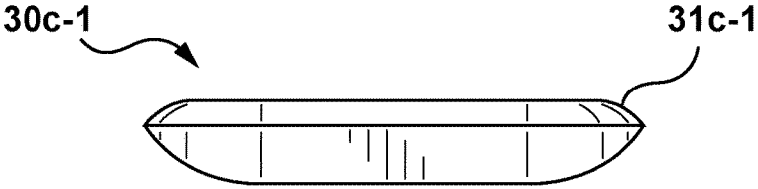
FIG. 13C is a side view of the stacking guide of FIG. 13A.
Figure 14B:
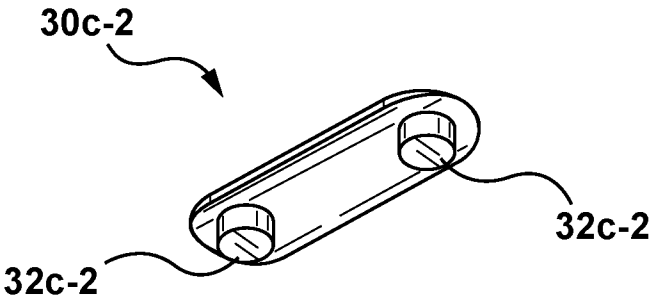
FIG. 14B is a bottom perspective view of the stacking guide of FIG. 14A.
Figure 14A:
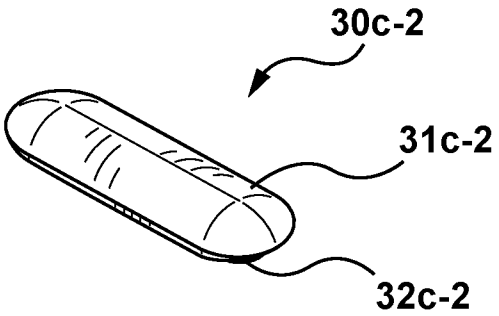
FIG. 14A is a top perspective view of another example stacking guide.
Figure 14D:
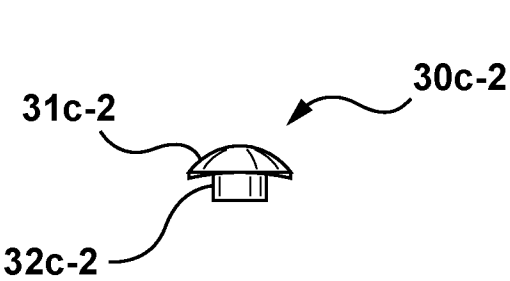
FIG. 14D is an end view of the stacking guide of FIG. 14A.
Figure 14C:
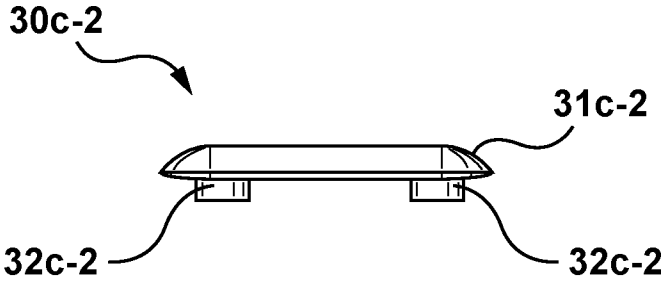
FIG. 14C is a side view of the stacking guide of FIG. 14A.
Figure 14E:
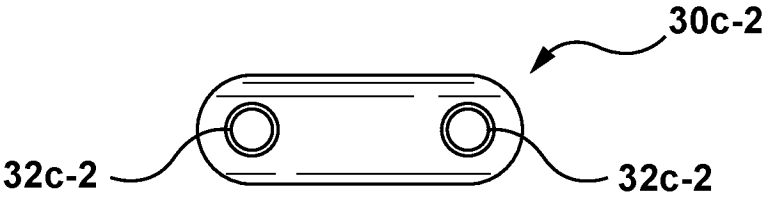
FIG. 14E is a bottom view of the stacking guide of FIG. 14A.

Referring to FIG. 11, a closer view of the stacking guides 30*b* is shown. In addition, FIG. 12A show a cross sectional of the stacking guides 30*b* lengthwise along the elongated member 20*b*. FIGS. 12B and 12C show a cross sectional of the stacking guides 30*b*-1 and 30*b*-2, respectively.

In the present example, the elongated member 20*b* includes anchor points onto which the stacking guides 30*b* may be mounted. The anchor points may be holes to interact with the pegs 32*b*-1 of the stacking guide 30*b*-1 and the pegs 32*b*-1 of the stacking guide 30*b*-1. The manner by which the pegs 32*b*-1 and 32*b*-2 interact with the holes is not limited. For example, the pegs 32*b*-1 and 32*b*-2 may be dimensioned to provide a friction fit within the hole such that they may be removeably added to the the elongated element. Accordingly, this may provide for easy replacement or installation if the stacking guides 30*b* are damaged. In other examples, the pegs 32*b*-1 and 32*b*-2 may be welded or soldered within the holes. In further examples, the pegs 32*b*-1 and 32*b*-2 may be bucked or riveted to the hole.

Furthermore, it is to be appreciated by a person of skill in the art with the benefit of this description that the stacking guides 30*b* may be retrofitted or installed on existing support members 10*b*. In the present example, holes may be drilled into the elongated member 20*b* to act as anchor points onto which the stacking guides 30*b* may be mounted. Although this example uses holes as an anchor point, other examples are contemplated. For example, the stacking guides 30*b* may be installed using adhesives or a magnet such that holes are not used. In such examples, any location on the surface of the elongated member 20*b* may be used as an anchor point.

Referring to FIGS. 13A, 13B, 13C, 13D, and 13E, various views of another stacking guide 30*c*-1 is shown. In the present example, the stacking guide 30*c*-1 includes a top surface 31*c*-1 and pegs 32*c*-1. Like components of the stacking guide 30*c*-1 bear like reference to their counterparts in the stacking guide 30*b*-1, except followed by the suffix "c".

In the present example, the stacking guide 30*c*-1 includes a shaped or curved bottom surface instead of a flat bottom surface. Accordingly, it is to be be appreciated that the stacking guide 30*c*-1 may be mounted on a rounded elongated member instead of a flat elongated member. For example, the radius of curvature of the stacking guide 30*c*-1 may be dimensioned to fit a rounded elongated member with a specific radius of curvature. In other examples, the stacking guide 30*c*-1 may be resiliently deformable such that it may accommodate an elongated member having a radius of curvature within a range. Furthermore, although the stacking guide 30*c*-1 is shaped to be mounted on a rounded elongated member, it is to be appreciated that the stacking guide 30*c*-1 may be modified to mount on elongated members having other shapes.

The pegs 32*c*-1 are to interact with the elongated member 20*c* to secure the stacking guide 30*c*-1 to the elongated member 20*c* and to prevent lateral movement of the stacking guide 30*c*-1 when lateral forces are applied. The pegs 32*c*-1 are not particularly limited and may be formed from a molding process to be part of a unitary body. In other examples, the pegs 32*c*-1 may be attached to the main body of the stacking guide 30*c*-1. Although the present example shows two pegs 32*c*-1, other examples may include more pegs 32*c*-1. Furthermore, some examples may also include a single peg 32*c*-1 since the curved surface mating with the surface of the rounded elongated member may reduce shifting or rotation of the stacking guide 30*c*-1 on the surface of the rounded elongated member.

Referring to FIGS. 14A, 14B, 14C, 14D, and 14E, various views of another stacking guide 30*c*-2 is shown in greater detail. In the present example, the stacking guide 30*c*-2 includes a top surface 31*c*-2 and pegs 32*c*-2. Like components of the stacking guide 30*c*-2 bear like reference to their counterparts in the stacking guide 30*b*-2, except followed by the suffix "c".

In the present example, the stacking guide 30*c*-2 includes a curved bottom surface instead of a flat bottom surface. Accordingly, it is to be be appreciated that the stacking guide 30*c*-2 may be mounted on a rounded elongated member instead of a flat elongated member. For example, the radius of curvature of the stacking guide 30*c*-2 may be dimensioned to fit a rounded elongated member with a specific radius of curvature. In other examples, the stacking guide 30*c*-2 may be resiliently deformable such that it may accommodate an elongated member having a radius of curvature within a range. Furthermore, although the stacking guide 30*c*-2 is shaped to be mounted on a rounded elongated member, it is to be appreciated that the stacking guide 30*c*-2 may be modified to mount on elongated members having other shapes.

The pegs 32*c*-2 are to interact with the elongated member 20*c* to secure the stacking guide 30*c*-2 to the elongated member 20*c* and to prevent lateral movement of the stacking guide 30*c*-2 when lateral forces are applied. The pegs 32*c*-2 are not particularly limited and may be formed from a molding process to be part of a unitary body. In other examples, the pegs 32*c*-2 may be attached to the main body of the stacking guide 30*c*-2. Although the present example shows two pegs 32*c*-2, other examples may include more pegs 32*c*-2. Furthermore, some examples may also include a single peg 32*c*-2 since the curved surface mating with the surface of the rounded elongated member may reduce shifting of the stacking guide 30*c*-2 on the surface of the rounded elongated member.

Figure 15:
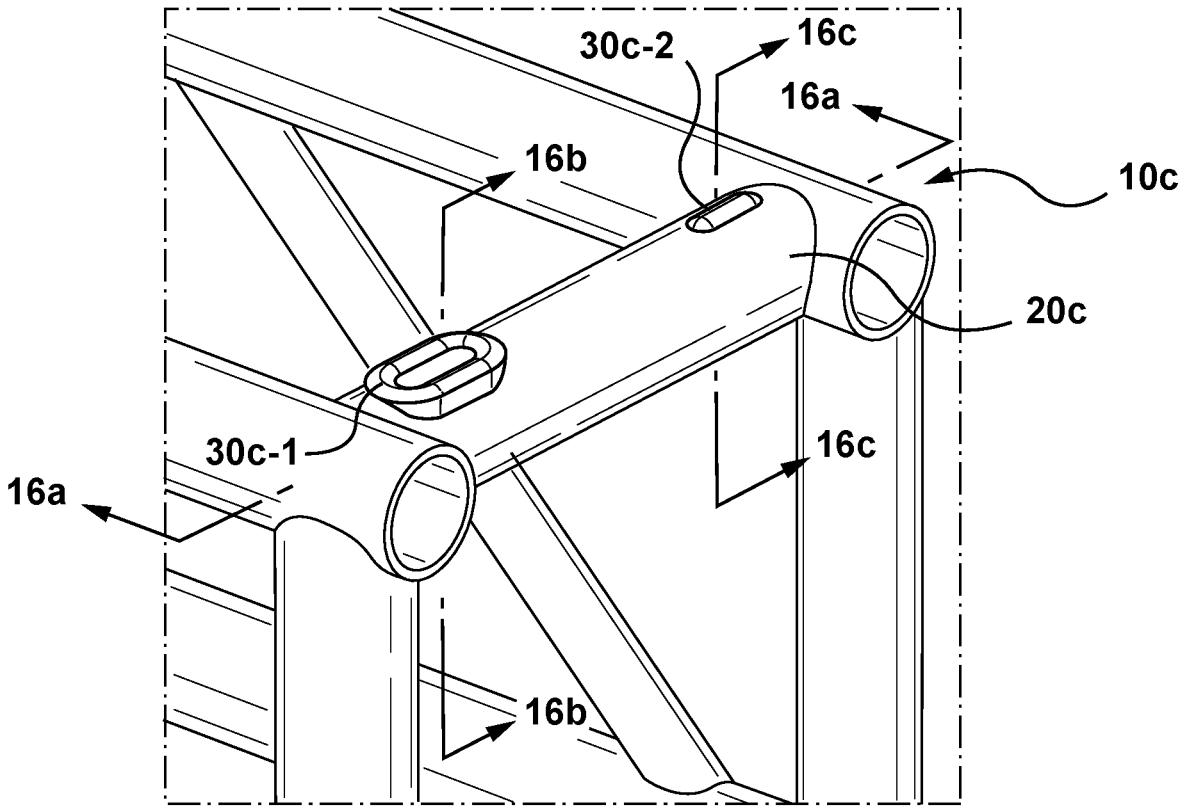
FIG. 15 is zoomed in view of an end of another example of a support member with the stacking guides of FIGS. 13A-E and 14A-E.

Referring to FIG. 15, a closer view of the stacking guides 30*c*-1 and 30*c*-2 is shown on a support member 10*c*. In addition, FIG. 16A show a cross sectional of the stacking guides 30*c*-1 and 30*c*-2 lengthwise along the elongated member 20*c*. FIGS. 16B and 16C show a cross sectional of the stacking guides 30*c*-1 and 30*c*-2, respectively.

In the present example, the elongated member 20*c* includes anchor points onto which the stacking guides 30*c* may be mounted. The anchor points may be holes to interact with the pegs 32*c*-1 of the stacking guide 30*c*-1 and the pegs 32*c*-1 of the stacking guide 30*c*-1. The manner by which the pegs 32*c*-1 and 32*c*-2 interact with the holes is not limited. For example, the pegs 32*c*-1 and 32*c*-2 may be dimensioned to provide a friction fit within the hole such that they may be removeably added to the the elongated element. Accordingly, this may provide for easy replacement or installation if the stacking guides 30*c*-1 and 30*c*-2 are damaged. In other examples, the pegs 32*c*-1 and 32*c*-2 may be welded or soldered within the holes. In further examples, the pegs 32*c*-1 and 32*c*-2 may be bucked or riveted to the hole. Furthermore, since the shape of the elongated member 20*c*, the mating surfaces may provide an additional mechanism to mount the stacking guides 30c-1 and 30c-2. In addition, the elongated member 20c may be shaped to mate with the stacking guides 30c-1 and 30c-2 in a single orientation to hold the stacking guides 30c-1 and 30c-2 at a specific location. For example, if the elongated member 20c had an oval cross section instead of a circular cross section, the stacking guides 30c-1 and 30c-2 may be dimensioned to fit at the top of the elongated member 20c.

Furthermore, it is to be appreciated by a person of skill in the art with the benefit of this description that the stacking guides 30c-1 and 30c-2 may be retrofitted or installed on existing support members 10c. In the present example, holes may be drilled into the elongated member 20c to act as anchor points.

It should be recognized that features and aspects of the various examples provided above may be combined into further examples that also fall within the scope of the present disclosure.

What is claimed is:

1. A support member comprising:

a plurality of elongated members connected to form a first elongated rigid structure;

a first elongated member of the plurality of elongated members disposed proximate to a first edge of the first elongated rigid structure with a first member top surface;

a first stacking guide disposed on the first elongated member wherein a first attachment top surface is to slope toward the first member top surface;

a second elongated member of the plurality of elongated members disposed proximate to a second edge of the first elongated rigid structure with a second member top surface, wherein the second edge is opposite the first edge; and a second stacking guide disposed on the second elongated member, wherein a second attachment top surface is to slope toward the second member top surface, and wherein the first stacking guide and the second stacking guide are to guide a second elongated rigid structure above the first elongated rigid structure, wherein the first elongated member includes an anchor point, wherein the first stacking guide is mounted onto the anchor point, and wherein the anchor point is a hole, and wherein the first stacking guide includes a peg to interact with the hole.

2. The support member of claim 1, wherein the first attachment top surface and the second attachment top surface are smooth to allow the second elongated rigid structure to slide thereon.

3. The support member of claim 2, wherein the first stacking guide guides a first attachment point on the second elongated rigid structure and the second stacking guide guides a second attachment point on the second elongated rigid structure to stack the second elongated rigid structure above the first elongated rigid structure.

4. The support member of claim 3, wherein the first stacking guide has a first shape to mate with the first attachment point on the second elongated rigid structure and the second stacking guide has a second shape to mate with the second attachment point on the second elongated rigid structure when stacked thereon.

5. The support member of claim 4, wherein the first shape of the first stacking guide and the second shape of the second stacking guide are different to permit the second elongated rigid structure to be aligned in a single orientation.

6. The support member of claim 1, further comprising additional stacking guides to form a base pattern, wherein the base pattern is to mate with a complementary pattern disposed on the second elongated rigid structure.

7. The support member of claim 6, wherein the base pattern and the complementary pattern are similar to permit the second elongated rigid structure to be stacked in multiple orientations.

8. The support member of claim 1, wherein the first stacking guide is removeably mounted with a friction fit of the peg in the hole.

9. The support member of claim 1, wherein the peg of the first stacking guide is welded in the hole.

10. A method comprising:

positioning a first support member having a stacking guide disposed on a first elongated member disposed at a top of the first support member, the stacking guide having a top surface to slope toward the first elongated member;

positioning a second support member having an attachment point disposed on a second elongated member disposed at a bottom of the second support member, wherein positioning the second support member comprises positioning the attachment point proximate to the stacking guide;

sliding the second support member relative to the first support member; and mating the attachment point with the stacking guide to align the second support member above the first support member, wherein the stacking guide is an oval shaped ring and the attachment point is a protrusion to fit within the oval shaped ring.

11. The method of claim 10, wherein mating the attachment point with the stacking guide comprises sliding the attachment point over a top of an edge of the oval shaped ring to be held in place by the oval shaped ring.

12. A support member comprising:

a plurality of elongated members connected to form a first elongated rigid structure;

a first elongated member of the plurality of elongated members disposed proximate to a first edge of the first elongated rigid structure with a first member top surface;

a first stacking guide disposed on the first elongated member wherein a first attachment top surface is to slope toward the first member top surface;

a second elongated member of the plurality of elongated members disposed proximate to a second edge of the first elongated rigid structure with a second member top surface, wherein the second edge is opposite the first edge; and a second stacking guide disposed on the second elongated member, wherein a second attachment top surface is to slope toward the second member top surface, and wherein the first stacking guide and the second stacking guide are to guide a second elongated rigid structure above the first elongated rigid structure, wherein the first attachment top surface and the second attachment top surface are smooth to allow the second elongated rigid structure to slide thereon, wherein the first stacking guide guides a first attachment point on the second elongated rigid structure and the second stacking guide guides a second attachment point on the second elongated rigid structure to stack the second elongated rigid structure above the first elongated rigid structure, wherein the first stacking guide has a first shape to mate with the first attachment point on the second elongated rigid structure and the second stacking guide has a second shape to mate with the second attachment point on the second elongated rigid structure when stacked thereon, and wherein the first shape of the first stacking guide and the second shape of the second stacking guide are different to permit the second elongated rigid structure to be aligned in a single orientation.

13. The support member of claim 12, further comprising additional stacking guides to form a base pattern, wherein the base pattern is to mate with a complementary pattern disposed on the second elongated rigid structure.

14. The support member of claim 12, wherein the first stacking guide is removeably mounted with a friction fit of a peg in a hole.

15. The support member of claim 12, wherein further comprising a peg of the first stacking guide welded in a hole.

* * * * *